US008865985B2

(12) United States Patent
Maslarov

(10) Patent No.: US 8,865,985 B2
(45) Date of Patent: Oct. 21, 2014

(54) TREMOLO DEVICE FOR STRINGED INSTRUMENT AND STRINGED INSTRUMENT

(76) Inventor: Teodor Dimitrov Maslarov, Sofia (BG)

( * ) Notice: Subject to any disclaimer, the term of this patent is extended or adjusted under 35 U.S.C. 154(b) by 0 days.

(21) Appl. No.: 14/117,372

(22) PCT Filed: Jun. 1, 2011

(86) PCT No.: PCT/BG2011/000009
§ 371 (c)(1),
(2), (4) Date: Nov. 13, 2013

(87) PCT Pub. No.: WO2012/162764
PCT Pub. Date: Dec. 6, 2012

(65) Prior Publication Data
US 2014/0202308 A1 Jul. 24, 2014

(51) Int. Cl.
*G10D 3/00* (2006.01)
*G10D 3/14* (2006.01)

(52) U.S. Cl.
CPC ..... *G10D 3/146* (2013.01)
USPC ..... 84/313

(58) Field of Classification Search
USPC ..... 84/411 R, 415–417
See application file for complete search history.

(56) References Cited

U.S. PATENT DOCUMENTS

| | | | | |
|---|---|---|---|---|
| 5,196,641 | A | 3/1993 | Schaller | |
| 5,520,082 | A * | 5/1996 | Armstrong et al. | 84/313 |
| 5,932,822 | A | 8/1999 | Bernstein | |
| 6,867,354 | B2 * | 3/2005 | Shimooka et al. | 84/312 R |
| 7,235,730 | B2 | 6/2007 | Hirayama | |

OTHER PUBLICATIONS

International Search Report, dated Sep. 29, 2011, from corresponding PCT application.

* cited by examiner

*Primary Examiner* — Kimberly Lockett
(74) *Attorney, Agent, or Firm* — Young & Thompson

(57) ABSTRACT

A tremolo device for stringed instrument and a stringed instrument. The tremolo device (1) includes base plate (2) with saddle assemblies (3) mounted independently and corresponding to strings. Each saddle assembly includes front (4) and rear (5) string saddle, located on the base plate upper surface and connected movably with asymmetric arms and connecting element (6). At each saddle assembly there is saddle mounting screw (7) for positioning to the base plate, string lock insert (9), string lock screw (10) for locking string (32) and fine tuning screw (8). To the base plate sustain block (16) is mounted with recesses (16*a*) and openings (16*b*), also housings (16*c*) with fine tuning springs (17), contacting with the respective rear (5) string saddle. To the sustain block (16) balancing mechanism (21) and tremolo arm (19) are settled. The stringed instrument is equipped with tremolo unit (1) and top lock unit (37).

14 Claims, 13 Drawing Sheets

C - C

D - D

D - D

E - E

G - G

H - H

TREMOLO DEVICE FOR STRINGED INSTRUMENT AND STRINGED INSTRUMENT

TECHNICAL FIELD OF THE INVENTION

The present invention relates to tremolo device for stringed instrument and stringed instrument and to electric guitar in particular. The electric guitar equipped with tremolo device and double locking tremolo, allows smooth pitch increase and decrease of tone being played without that resulting later in strings coming out of tune. The present tremolo device can be used on other stringed instruments, more specifically on electric guitars with non-locking tremolo, as well as on such with fixed bridge, thus increasing the stringed instrument functions and capacity.

BACKGROUND ART

In stringed instruments, particularly in the electric guitar, strings vibration is limited within the area between the bridge and the nut, respectively and/or the top lock unit. The bridge is located in the rear portion of the body and is used for locking strings on the body side. The most spread types of guitar bridges are the fixed bridge and the tremolo. Tremolo devices themselves are usually divided into non-locking tremolo and double locking tremolo.

The standard (non-locking) tremolo devices known from the art allow locking of one end of strings, adjusting the strings height thus allowing perfect intonation adjustment and smooth decrease with several tones of a tone being played. On the other side, the utilization of the standard tremolo device results in strings coming quickly out of tune, this type of devices featuring also difficulty in tuning and strings coming out of tune in case of breaking of one of them. Also with existing musical instruments equipped with the standard tremolo device (Non-Locking Tremolo), it is impossible to replace it with double locking tremolo without additional complicated and precise operations such as drilling, milling and painting of the guitar body and neck, the result not always being satisfactory.

The known double locking tremolo devices ensure locking of both ends of each string and allow performing of all the main functions of the non-locking tremolo, avoiding the problems with strings coming out of tune. In addition, the double-locking tremolo devices allow fine tuning after strings are already locked and smooth increase in pitch of a tone being played with several half-tones. On the other side, this type of tremolo device also features difficulties in tuning as with pulling of one string the remaining strings get loosened and the process of tuning of all strings is repeated several times to achieve a good result. The known double-locked tremolo devices have complicated construction with many components, this resulting in significant higher price of the unit and more difficult maintenance. In view of this, it is difficult to adapt and mount the known double-locking tremolo devices on existing instruments, equipped with non-locking tremolo or fixed bridge as complicated manipulation is required for drilling and painting the guitar body and neck.

From U.S. Pat. No. 7,235,730, published on 26 Jun. 2007, possessed by Hoshino Gakki Co. Ltd, Japan and inventor—Shinjiro Hirayama "A Tremolo Bridge for Stringed Instrument and Stringed Instrument" /1/ is known. According to the description to the patent, the tremolo bridge, hereinafter the tremolo device, is intended for stringed instrument, in particular an electric guitar with double string locking. The guitar includes a body, neck with strings and headstock, on the back portion of which the machine heads are mounted. In the body area a tremolo device and adapters for the electronic part are mounted, and at the neck end a top lock unit is provided.

The tremolo device includes a base plate on the upper surface of which a set of saddle assemblies are mounted, corresponding to the number of the instrument strings. Each saddle assembly is formed by lever arm retainer and lever arm, pivotally supported by support shaft, located perpendicularly to the corresponding string and allowing rotation of the lever arm with respect to the lever arm retainer. The base plate is mounted to the instrument body by means of hinge mechanism. String fine tuning devices are provided to the base plate as well as a mechanism for tremolo device manipulation, including a tremolo arm. To the base plate lower side a sustain block is mounted, at the lower end of which a tension applying mechanism is provided with springs mounted also to the lower side of the instrument body.

Each saddle assembly is mounted independently to the base plate and is located along the strings direction. For each saddle assembly cylindrical surface of lever arm is shaped as receiver of the respective string. Each string is fixed in the lever arm of the saddle assembly by cubical clamping block and string fixing bolt provided in a housing formed to this purpose in the lever arm. A spring is provided between the lever arm and lever arm retainer housed in a housing formed in the middle portion of the lever arm. Each lever arm retainer is movably mounted to the base plate as in its front portion a slot is formed in which a bolt is provided and which bolt is statically screwed up in a threaded bore formed in the base plate thus providing for locking of the corresponding saddle assembly to the base plate after intonation adjustment.

The hinge mechanism for fixing the base plate to the instrument body includes a pair of brackets disposed at base plate both ends crosswise to the strings direction and a pair of rotary shafts. Each rotary shaft is supported by both ends of one of the brackets. On left and right sides of the base plate two bearing devices are formed, each one housing a bearing, so that the base plate pivots with respect to the body via the corresponding rotary shaft.

The string fine tuning device includes fine tuning screws and a D tuner device.

For strings fine tuning, fine tuning screws are provided for each saddle assembly of the tremolo device for each one of the five strings. Each screw has a threaded part, smooth part and a head, the threaded part being screwed up statically in the cylindrical bush provided at the base plate back side. The screw smooth part passes through the respective slot of the lever arm from the saddle assembly. In this position the lever arm back end contacts with the screw in a contact surface formed at the lower side of its head, wherein each lever arm is tightened around the corresponding support shaft by means of string tension.

A D tuner device is provided on the base plate at the saddle assembly for the sixth string instead of the fine tuning screw. The device includes cylindrical tuner body and base screw housed in the cylindrical body and is screwed up in a threaded bore provided in the base plate. In the cylindrical tuner body two pairs of engaging recesses and two pairs of inserting recesses are formed at different depth which are perpendicular to each other and which are formed with rectangular cross section with respect to the central hole through which the base screw passes in which adjustment screw is provided screwed up in the base screw by which the tuner tuning of the sixth string is performed.

The tremolo bridge manipulating mechanism includes a threaded cylinder provided at the side base plate portion and directed downwards, wherein the cylinder is mounted to the base plate by means of a nut which is screwed to its lower end on the lower side of the base plate. The tremolo arm is mounted in the cylinder. During tremolo arm manipulation—pulling upwards or pressing the arm Downwards—a slight rotation of the base plate is realized together with the set of saddle assemblies and the sustain block about the shafts housed in the bearing devices of the hinge mechanism against the force created by the tension applying mechanism mounted to the sustain block.

The tension applying mechanism is intended to return the base plate in a balanced position and is provided in the lower portion of the sustain block mounted to the lower surface of the base plate. The tension applying mechanism is housed in a cavity formed to the purpose at the instrument body back side and includes mainly two pairs of springs—two external between which two internal springs are disposed. The pair of internal springs is mounted in its front end to adjustment member connected to adjustment screw mounted to the vertical support piece of a plate statically fixed in the body cavity. The pair of external springs is mounted such as their front ends are fixed to a couple of engaging pins provided in the plate statically fixed in the body cavity. The external springs back ends are fixed to a support rod which is disposed in the back portion of the sustain block, perpendicularly to the neck. The support rod is disposed between V-shaped engaging portions formed in the base. Thus, the V-shaped engaging portions, the pair of external and internal springs, the support rod, adjustment member and screw form the tension applying mechanism to maintain the sustain block and base plate balancing state and bring them back in balanced position.

The tremolo device for stringed instrument according to /1/ possesses the same characteristics as the above described known double locking tremolo devices and provides for slight or almost no strings coming out of tune in case of more serious operation of the device and also opportunity for quick and precise fine tuning.

On the other side in the tremolo device according to /1/ all the above mentioned difficulties in tuning and problems are met that are typical of instruments with double locking tremolo device. In addition, the tremolo device known from /1/:

- has a complex construction with many components which leads to significant raising of the instrument cost and to its more difficult maintenance;
- in order to use standard strings, their ends (ball strings) have to be cut off in advance;
- has smaller sustain block resulting in quicker sound attenuation and a sound poorer in harmony;
- it is difficult to adapt and mount it on another type of existing instruments with standard tremolo device or fixed bridge, as the fine tuning screws are moved rather backwards and project beyond the device contour, this leading to complicated milling operations for drilling the guitar body, besides that, when being utilized and the musician's palm being laid upon the tremolo device, it touches the fine tuning screws which leads to additional coming out of tune of the instrument.

According to /1/, the top lock unit provided at the end of the stringed instrument Neck—the electric guitar—combines the functions of the top lock unit and the intonation nut providing for strings locking at the neck.

From the art is known also a "Locking Nut Assembly for Musical Stringed Instruments", disclosed in U.S. Pat. No. 5,932,822, published on Mar. 8, 1999, possessed and invented by St. Bernstein /2/. The locking nut assembly is mounted at the end of neck in the area of instrument headstock between the intonation nut and the machine heads.

The known solution /2/ includes a clamping block with tab member mounted by screws to the instrument headstock and formed as integral part of upper wall, lower walls, side longitudinally opposite walls, end cross walls and two internal partial walls which form three internal passageways. To the clamping block, within the formed internal passageways are mounted three countersunk cone-headed screws on both sides of which one string of the instrument is disposed. Within the formed internal passageways on the base plate are provided freely disposed tab members in which the ends of the countersunk head screws are screwed up, to the face of which a tool receiving slot is formed. On the clamping block a locking and releasing mechanism is disposed, including a cylindrical body housing a spindle with a spring, the face spindle surface having a tip—a machine head with identical to the tool receiving slot shape, provided to the end of each screw. At the upper spindle end a rotating lever is provided by means of which the locking and releasing mechanism is shifted along the upper wall of the clamping block. After positioning the mechanism above the screw head, the spindle is engaged to the tool receiving slot in the screw head and is rotated by pressing the respective tab member to the fixing clamping block lower wall, thus locking the respective strings.

The known according to /2/ locking assembly has rather complicated form and a set of components making it cumbersome to operate. In addition, in the known locking assembly:

- the provided locking and releasing mechanism on the fixing base plate is unnecessarily complicated as the strings releasing and locking is used only and solely with strings replacement;
- the cone-headed screws do not provide even distribution of the compression force on the pair of strings as the strings of the two sides of each screw are with different thickness, i.e., when locking, the thinner string remains unlocked or loosely locked;
- the fixing of the locking and releasing mechanism to the guitar headstock results in a rather complex shape body and utilization of greater number of and more complicated components.

DISCLOSURE OF THE INVENTION

The object of the present invention is to present a tremolo device for stringed instrument, which can provide all possibilities for adjustment, locking and tuning of the known double locking tremolo devices, at the same time having a simple and universal construction with small number of components which can allow its utilization and mounting on instruments both with double locking tremolo devices and with standard tremolo devices (non-locking tremolo) without performing additional complicated operations for the instrument adaptation.

Another object of the invention is to propose a tremolo device with construction allowing the utilization also of standard strings with balls (ball strings).

An object of the invention is to propose also a stringed instrument with tremolo device according to the present invention which in combination with a top lock unit can provide quick and secure string locking, precise adjustment and tuning of strings, as well as slight and insignificant strings coming out of tune during performance with the instrument.

The tremolo device for stringed instrument includes a base plate on the upper surface of which is mounted independently of each other a set of saddle assemblies, whose number corresponds to the number of the instrument strings. Each saddle assembly includes a front and rear string saddle, connected by connecting element disposed perpendicularly to the respective string and allowing for rotation of the rear saddle, also elements for fine tuning and intonation are mounted to each saddle assembly. To the base plate lower surface a sustain block is mounted at the lower end of which a balancing mechanism is settled with elastic elements fixed to the sustain block, and in their other end—secured to the instrument body. A pivot assembly is provided to the tremolo device for mounting the base plate movably to the instrument body and a manipulation mechanism with a tremolo arm.

According to the invention, each saddle assembly including a front and rear string saddle is formed so that the front and rear string saddles are disposed with their lower surfaces on the base plate upper surface, the saddle assemblies being with low profile and smooth upper surface which is of special importance to guitarists and does not obstruct their performance. The front and rear string saddles are formed with asymmetrically projecting arms, movably connected by means of the connecting element, disposed perpendicularly to the corresponding string and allowing for the rear saddle rotation. In the front portion of the front string saddle, a slot in parallel to the corresponding string is formed, through which slot a connecting screw is passing mounted in the base plate to one of the at least two provided threaded bores. In the back portion of the rear string saddle, coaxially to the slot in the front string saddle, a rear slot is provided, in which a fine tuning screw is mounted, fixed in the base plate to one of at least two provided threaded bores. From the rear slot on the rear string saddle upper threaded opening is formed, reaching the rear string saddle back wall. To the tremolo device a magnet adjustment screw is provided for mounting to the upper threaded opening in the rear string saddle, contacting with the head of the fine tuning screw, for string saddle intonation adjustment with "x" displacement.

In the rear string saddle front portion a string receiving recess for the corresponding string is formed in parallel with but displaced with respect to the axis of the slot in the front string saddle and the rear slot in the rear string saddle. The string receiving recess reaches the provided front slot in the rear saddle through which the corresponding string passes. From the front slot to the back wall of the rear string saddle a lower threaded opening is formed reaching the rear string saddle back wall.

The sustain block mounted on the base plate lower side has formed recesses which number corresponds to the number of the instrument strings. In the recesses, on one side, pass two-step holes are formed to the lower side of the sustain block, and on the other side, vertical housings are provided, in which elastic elements are mounted. Each elastic element—a spring—passes through an opening provided in the tremolo device base plate and contacts with the lower surface of the corresponding rear string saddle, thus providing for its rotation around the connecting element of the saddle assembly at "y" angle with respect to the base plate surface.

According to a preferred embodiment of the present invention, the tremolo device provides for locking strings in it, wherein to the rear string saddle of each of the saddle assemblies corresponding to the instrument strings number, a string lock insert is provided, which is mounted in the front slot of the rear string saddle and is fixed by a string lock screw to the corresponding string, provided in the formed lower threaded opening extending from the front slot to the back wall of the rear string saddle.

The string lock insert, fixing the corresponding string, according to a preferred embodiment of the present tremolo device is formed by a head and a cylindrical body, the head being cut off forming a flat part. In the lower portion of the string lock insert cylindrical body a recess is formed intended to receive the back portion of the string lock screw provided in the rear string saddle.

According to the present invention the connecting element for the front and rear string saddle of each saddle assembly is preferably constructed in two options. In the first option the connecting element is a saddle assembly screw, which is freely mounted through an opening in the asymmetric arm of the front string saddle and is screwed up in the rear string saddle arm. According to the second option, the connecting element is a support shaft driven in provided openings in front and rear saddle arms and is secured against removal.

According to a preferred embodiment of the tremolo device for stringed instrument the magnet adjustment screw for intonation adjustment and fine tuning includes a corpus, a hexagonal screw and a magnet.

In one embodiment of tremolo device for stringed instrument, the balancing mechanism springs are fixed to the lower part of the sustain block by suspending elements, formed as spring hooks and locking screws, and their other end is fixed to a spring claw, mounted to the instrument body by means of spring claw screws.

In another embodiment of tremolo device for stringed instrument, the manipulation mechanism includes a tremolo arm mounted in a bush, fixed in the sustain block. The arm passes through an opening in the base plate and is locked by tremolo arm lock screw in the sustain block, the tremolo arm lock screw being compressed with the necessary pressure to the bush.

A basic advantage of tremolo device according to the invention is that it has simplified and universal construction allowing its installment on stringed instruments both with double-locking tremolo device and with non-locking tremolo device, and possessing all possibilities for adjustment of the double-locking tremolo systems. According to the invention the number of the tremolo device components is significantly decreased by using standard details, the tremolo device mounting does not require complicated operations for drilling, milling and adapting of the instrument body, also resulting in decreasing the number of technological operations in producing of a musical instrument with inbuilt double-locking tremolo device.

The tremolo device according to the invention can be also utilized with standard strings (ball strings), which is not necessary to cut, thus avoiding an additional operation.

The tremolo device construction is compact, with low profile and smooth upper surface as the front and rear string saddles of the saddle assembly are with asymmetrical arms and are disposed on the base plate upper surface wherein each saddle assembly is formed so that the string lock screw for the front string saddle and the fine tuning screw are displaced in different plane from the one where the corresponding string lies on. Thus the strings are not in the way during the instrument tuning which is of special importance to guitarists as it does not obstruct their performance, this also provides small length of the saddle assembly and of the tremolo device respectively. In addition, using compressing spring housed in the rear end of sustain block, which contacts with the lower surface of the corresponding rear string saddle provides for easy and smooth "y" rotation of the rear string saddle with respect to the front saddle and the upper surface of the base plate for string fine tuning.

On the other side the tremolo device sustain block according to the invention is more solid and allows obtaining of warmer, more harmonious and more sustainable sound of the instrument.

The proposed magnet adjustment screw is universal and allows performing of the necessary adjustments—locking the string on both ends, precise intonation adjustment, fine tuning of the strings. Because of the magnet adjustment screw the necessity drops off of projecting of fine tuning screws with wide heads beyond the tremolo device. The availability of inbuilt magnet in the magnet adjustment screw provides it with enough force to adhere to the corresponding screw even when turning, shaking or inclining the guitar.

The balancing mechanism is simplified, as fixing the springs in the sustain block by hooks and also by means of tremolo spring lock screws ensures reliability and the necessity drops off of using spring retainer and two fixing screws to compress the springs to the sustain block.

The stringed instrument includes a body, from which a neck stretches and a set of strings deposited on the neck. At the neck end a nut and a headstock with machine heads are provided, in which the strings are locked. Behind the nut a top lock unit is provided, and at the upper surface of the instrument body, tremolo device and adapters are mounted according to the present invention.

The tremolo device is movably mounted to the stringed instrument by a pair of pivot studs and pivot inserts fixed in the instrument body. The tremolo device includes a base plate on which a set of saddle assemblies are mounted independently of each other, whose number corresponds to the number of the strings of the instrument. Each saddle assembly includes a front and rear string saddle, disposed with their lower surfaces on the base plate upper surface and is formed with asymmetrically projecting arms, fixed by connecting element, disposed perpendicularly to the corresponding string. In the front portion of the front string saddle, in parallel to the corresponding string, a slot is formed through which a saddle mounting screw is provided, mounted to the base plate in one of the at least two provided threaded bores. In the back portion of the rear string saddle, coaxially to the slot in the front string saddle a rear slot is formed through which a fine tuning screw is mounted, fixed to the base plate in one of at least two provided threaded bores. From the rear slot to the back wall of the rear string saddle an upper threaded opening is formed, intended for intonation adjustment with displacement "x" by a magnet adjustment screw. In the front portion of the rear string saddle, in parallel with the axis of the slot in the front string saddle, a string receiving recess is formed extending to a front slot from which a lower threaded opening extends reaching the back wall of the rear string saddle.

On the base plate lower side a sustain block is mounted in which recesses are formed, which number corresponds to the number of the instrument strings. In the recesses, on one side pass two-step holes are formed to the sustain block lower side, and on the other side vertical housings are provided in which elastic elements are mounted. Each elastic element—a spring, passes through an opening provided in the tremolo device base plate and contacts with the lower surface of the corresponding rear string saddle for its rotation at a set angle "y" with respect to the base plate surface.

On the sustain block lower side a balancing mechanism is settled including balancing tremolo springs which are fixed in one end by means of formed hooks and spring fix screws in the lower end of sustain block, and in the other end are fixed by means of a spring claw to the instrument body.

To the tremolo device a manipulation mechanism is provided including tremolo arm, mounted in a tremolo arm bush fixed in the sustain block, the arm passing over the base plate through an opening in it and is fixed by a tremolo arm lock screw in the sustain block.

The top lock unit is mounted tightly behind the nut on the stringed instrument headstock by top lock screws and washers. The block consists of U-shaped top lock base with convex inside oval surface and suitably formed string openings in the side walls. In the internal top lock base space clamping plates are provided, their number depending on the number of the instrument strings.

The clamping plates are formed with concave oval upper surface, a mirror corresponding configuration to the top lock base convex oval surface/inside upper wall. They are compressed by clamping plate screws with their upper surface to the internal upper side of the U-shaped top lock base, wherein each clamping plate forms two adaptive recesses for every two strings of the instrument. To distribute the compression effort on each pair of strings, compressed by the corresponding clamping plate, on the upper side of the U-shaped top lock base the surface under the clamping plate screw heads is prism-formed.

According to a preferred embodiment of the present invention, the stringed instrument is with double-locking strings, provided for in the tremolo device and the top lock unit. The tremolo device ensures locking the strings in it, as to the rear string saddle of each saddle assembly, corresponding to the number of strings, a string lock insert is provided. The string lock insert is mounted in the front slot in the rear string saddle and is fixed by the string lock screw, housed in the lower threaded opening extending from the front slot in the rear string saddle. The corresponding string of the stringed instrument according to the invention is disposed in the provided pass two-step hole in the tremolo sustain block, so that the ball of each string is located on the lower side and provides "w" movement when touching the opening narrowing portion. After that the string passes through the front slot in the rear string saddle where it is fixed by the string lock insert and is locked by the string lock screw. Then the string extends on the string receiving recess provided in the front portion of the rear string saddle, on the instrument neck and from the nut to the top lock unit where it is fixed in the recess formed by the clamping plate and the U-shaped top lock base by the clamping plate screws. After the top lock unit the string is fixed in the corresponding machine head to the instrument headstock.

According to this embodiment of the stringed instrument with tremolo device according to the invention and with top lock unit, the strings are double-locked, which provides for slight or almost no coming out of tune of the instrument during performance, as well as opportunity for fine tuning with possibilities for adjustment and tuning of the known double-locking tremolo devices.

According to another option, the stringed instrument is constructed with tremolo device according to the invention, of the standard (non-locking) tremolo type and a top lock unit. In this embodiment the string is mounted in the tremolo device rear string saddle, as it is in the formed lower threaded opening extending from the front slot to the back wall of the rear string saddle, so that the ball touches the narrowing portion of the pass two-step threaded lower opening in the rear string saddle. After that the string extends through the front slot in the rear string saddle and is disposed in the provided string receiving recess. From the tremolo device the string extends on the instrument neck and through the nut is fixed in the top lock unit, in the recess formed by the corresponding clamping plate and the U-shaped top lock base by means of clamping plate screws. After the top lock unit the string is wound in the corresponding machine head to the instrument headstock.

According to this embodiment of stringed instrument with tremolo device according to the invention, constructed as standard tremolo (Non-Locking tremolo) and with top lock unit, where the strings are locked, opportunity is provided for strings fine tuning and intonation adjustment, as well as slower loss of strings tuning during performance with the instrument.

BRIEF DESCRIPTION OF THE DRAWINGS

The present invention is clarified by the attached figures which illustrate it as follows.

BEST MODE FOR CARRYING OUT THE INVENTION

Figure 6:
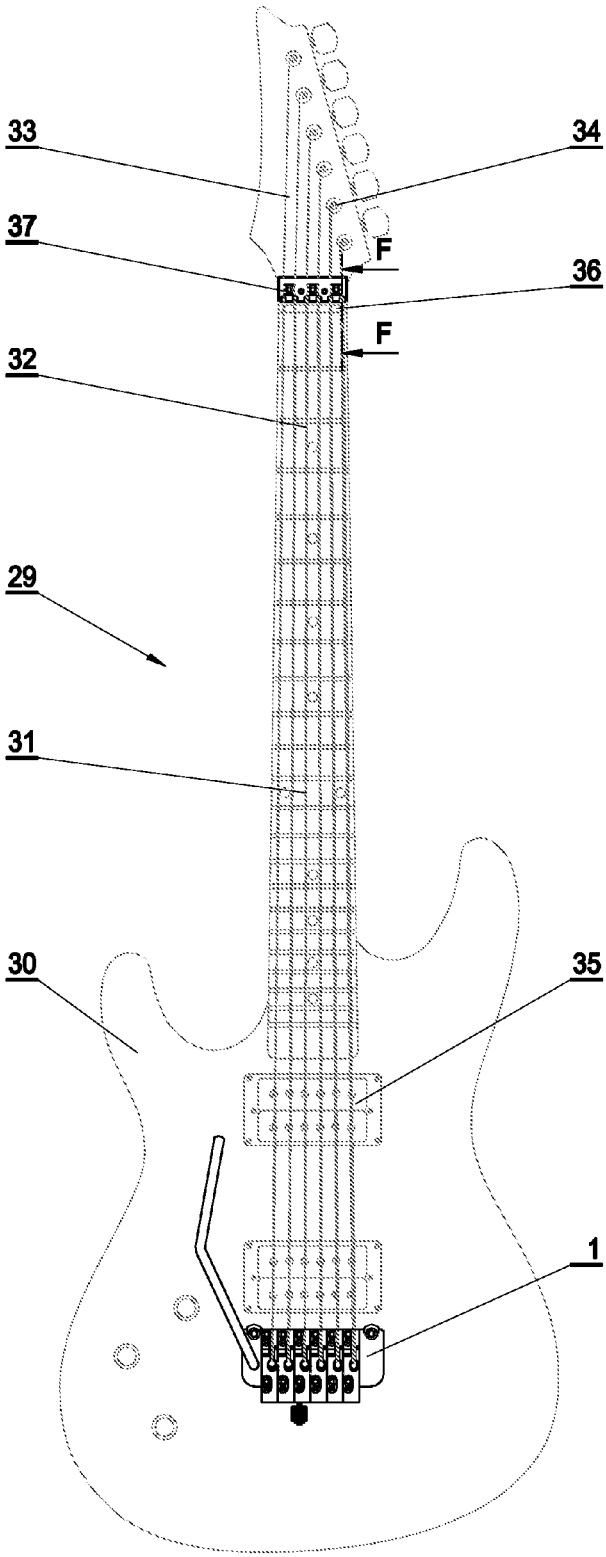
FIG. 6 illustrates a stringed instrument—a guitar, equipped with tremolo device illustrated in FIG. 1 and top lock unit.

The tremolo device 1 according to a preferred embodiment of the present invention is illustrated in FIGS. 1 to 19. The illustrated embodiment of tremolo device is for stringed instrument—left handed electric guitar as shown in FIG. 6.

Figure 1:
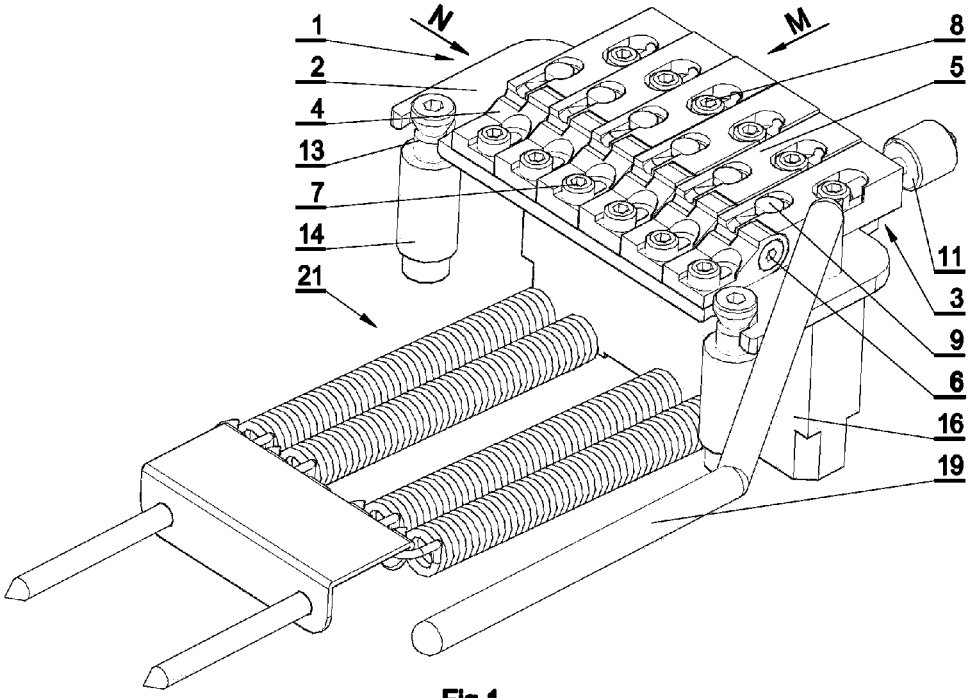
FIG. 1 is a plan axonometric view of the tremolo device according to this invention.
Figure 2:
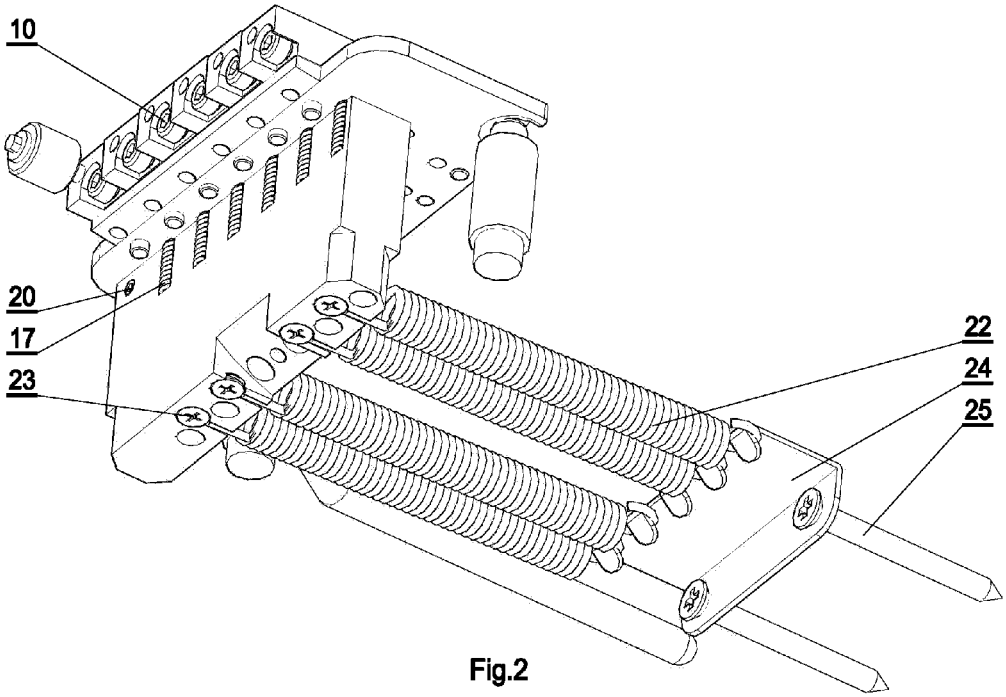
FIG. 2 is axonometric view from the lower side of the device of FIG. 1.

The device 1, shown in FIG. 1 and FIG. 2 consists of flat rectangular base plate 2, on the upper surface of which are independently mounted saddle assemblies 3, corresponding to the number of the instrument strings.

Each saddle assembly 3 consists of front 4 and rear 5 string saddles disposed in one plane on the base plate 2 and have formed asymmetrically projecting arms. The front 4 and rear 5 string saddles are movably connected by means of connecting element 6 disposed within the asymmetric arms mounted one next to the other, the connecting element 6 being located perpendicularly to the corresponding string and providing for rotation of the saddle assembly. According to a preferred embodiment shown in FIG. 12*a*, the connecting element 6 is a screw, freely passing through an opening in the arm of the front string saddle 4 and screwing up in a threaded bore in the arm of the rear string saddle 5. According to a second embodiment the arms of the saddle assembly 3—the front 4 and rear 5 string saddles are connected by means of support shaft 6, illustrated in FIG. 12*b*.

Figure 9:
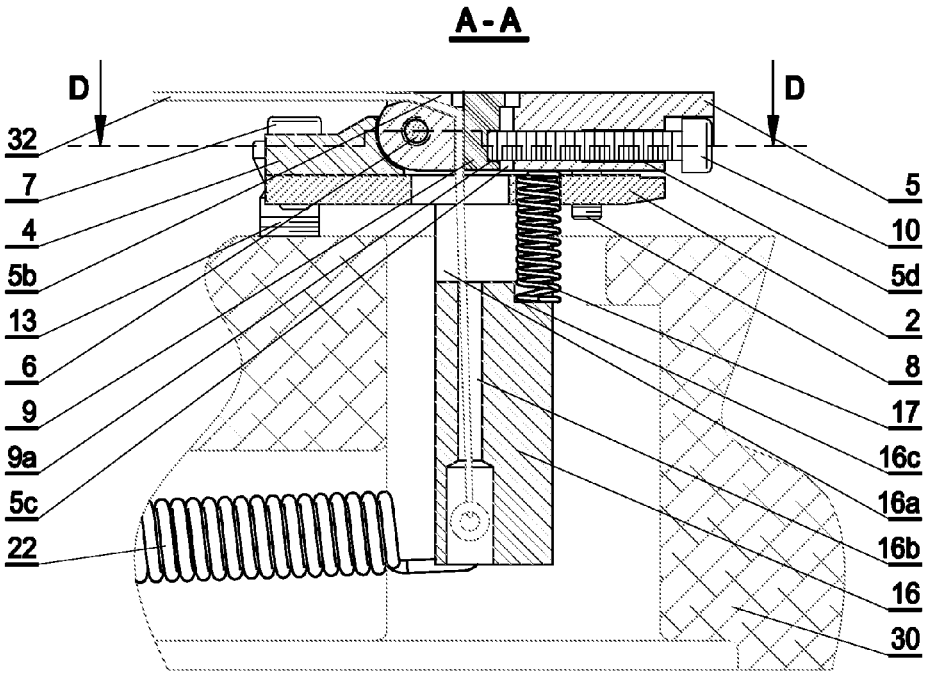
FIG. 9 is a part section taken through A-A of FIG. 7.
Figure 12A:
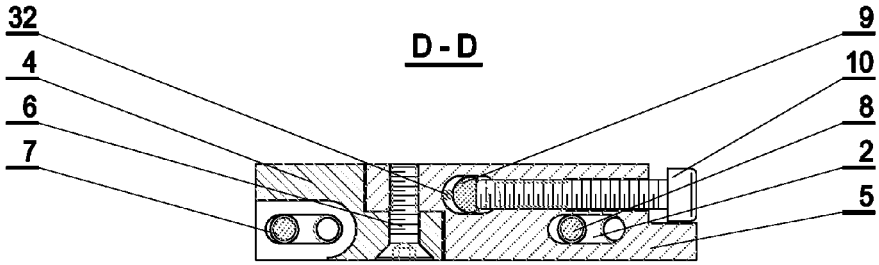
FIG. 12*a* and 12*b*—is a part section taken through D-D of FIG. 9 in two embodiments of the saddle assembly screw or support shaft for the front and rear string saddle.
Figure 12B:
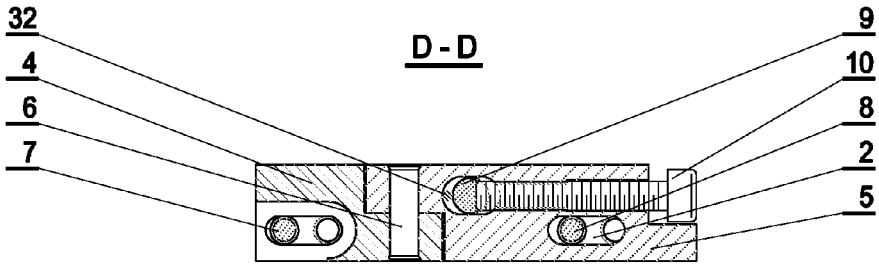

To each saddle assembly 3 means are provided for their fixing and positioning (FIG. 13*a*-13*d*) on the base plate 2 for fine tuning (FIG. 16*a*-16*c*) and string locking (FIG. 17*a*-17*b*), wherein:

- in the front 4 string saddle a slot 4*a* is formed, housing a saddle mounting screw 7 mounted in one of the provided pair of threaded bores at the base plate 2 (FIG. 10 and FIGS. 13*a*-13*d*);
- in the back portion of the rear 5 string saddle a rear slot 5*a* is formed, where a fine tuning screw 8 is provided, mounted to one of a pair of threaded bores at the base plate 2 (FIG. 10 and FIGS. 16*a*-16*c*);
- the saddle mounting screw 7 to the front 4 string saddle and the fine tuning screw 8 to the rear 5 string saddle are disposed along an axial line displaced with respect to and parallel to the string as illustrated in FIGS. 7, 10 and FIGS. 13*a*-13*d;*
- in the front part of the rear 5 string saddle a string receiving recess 5*b* is formed, reaching the formed front slot 5*c*, which axis is parallel to the slot 4*a* in the front 4 string saddle and the back slot 5*a* and in this front slot 5*c* a string lock insert 9 is mounted for locking the instrument string (FIG. 9 and FIGS. 14*a*, 14*b* and FIGS. 17*a* and 17*b*);
- from the front slot 5*c* in the rear string saddle 5 to the back vertical wall a lower threaded opening 5*e* is disposed, in which a string lock screw 10 is mounted and which is screwed up to the front slot 5*c* and to the mounted in it string lock insert 9 as illustrated in FIGS. 9, 12*a* and 12*b*; 14*a* and 14*b*; 17*a* and 17*b*. Thus the string lock screw 10 head is hidden in part of a formed additional slot, so there are no projecting components and the rear string saddle 5 is compact and simple;

to the back vertical wall of the rear 5 string saddle upper threaded opening 5*d* is provided reaching the rear slot 5*a* in the rear 5 string saddle (FIG. 10 and FIGS. 13*a*-13*d*) for intonation adjustment by means of magnet adjustment screw 11 (illustrated in FIG. 13*c* and FIG. 19), contacting with the fine tuning screw 8 head.

The front 4 and rear 5 string saddles formed with asymmetric arms as above described, the provided coaxial slots 4*a* and 5*a* in them which are parallel but displaced with respect to the corresponding string axis, allow quick, precise and easy tuning without the corresponding string preventing these tunings. In addition, this construction of the front 4 and rear 5 saddles provides for little height (low profile) and smooth upper surface of the tremolo device 1, which is of great importance to guitarists and does not obstruct their performance.

Figure 3:
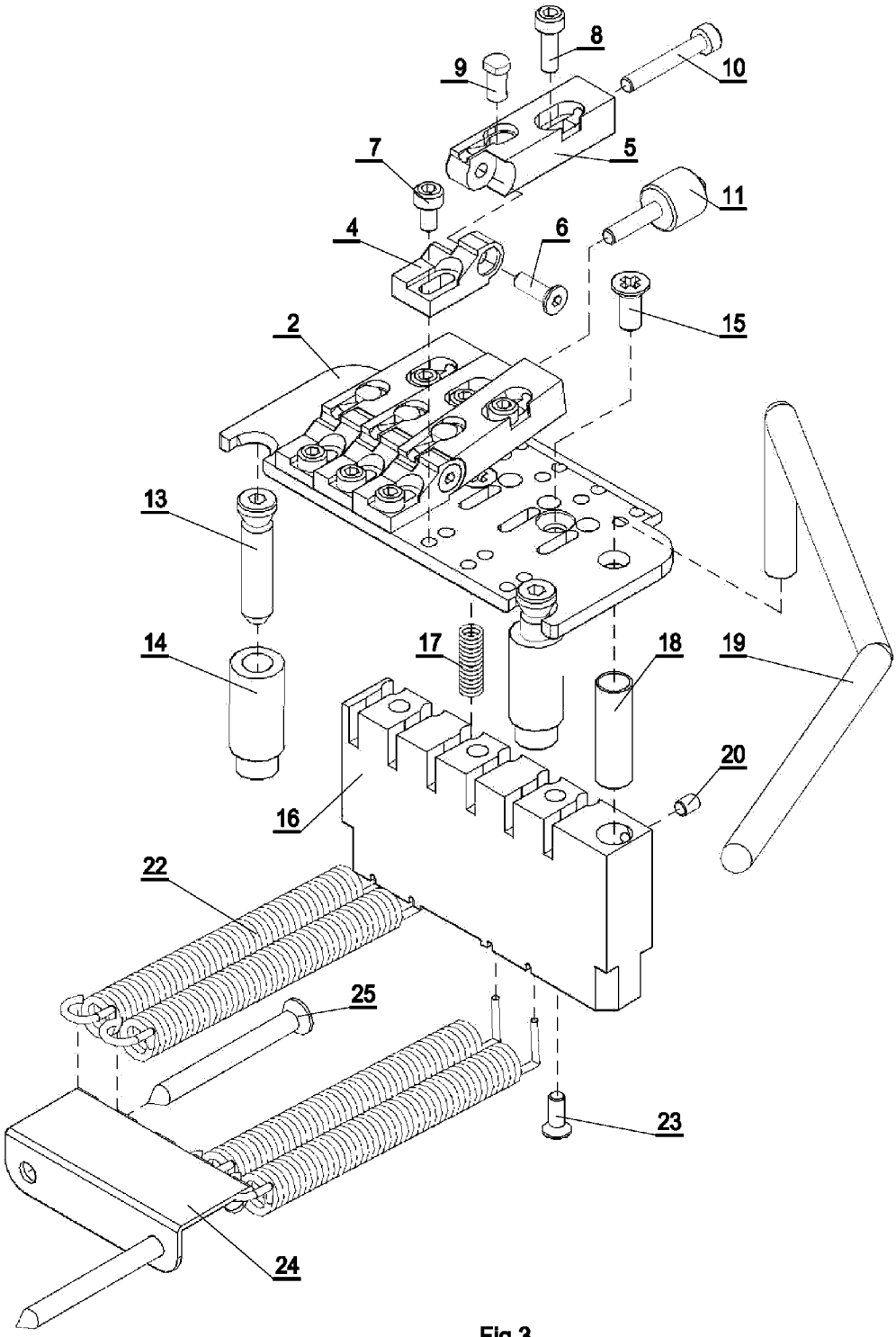
FIG. 3 illustrates the components of the tremolo device of FIGS. 1 and 2 in exploded view and the order of their assembly.
Figure 4:
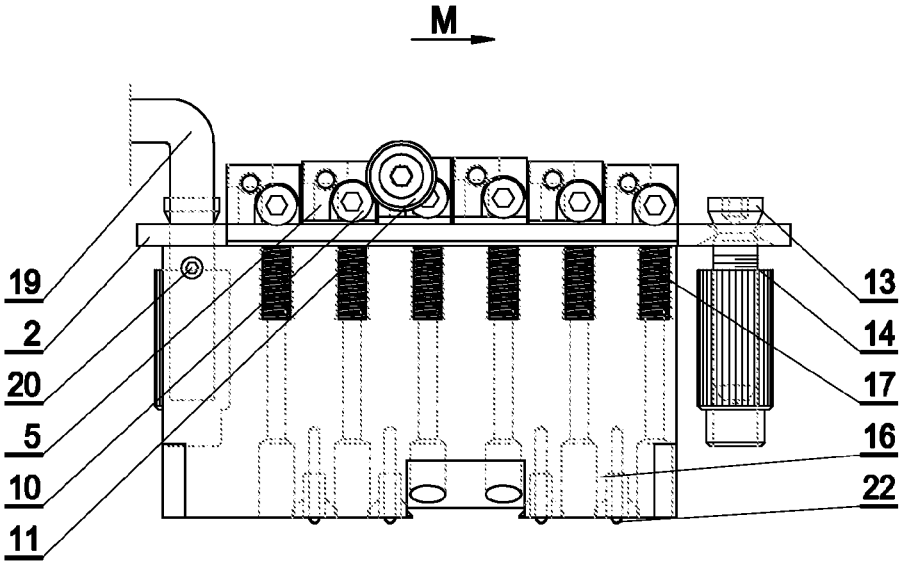
FIG. 4 is a view in the direction of the arrow M of the tremolo device illustrated in FIG. 1.
Figure 5:
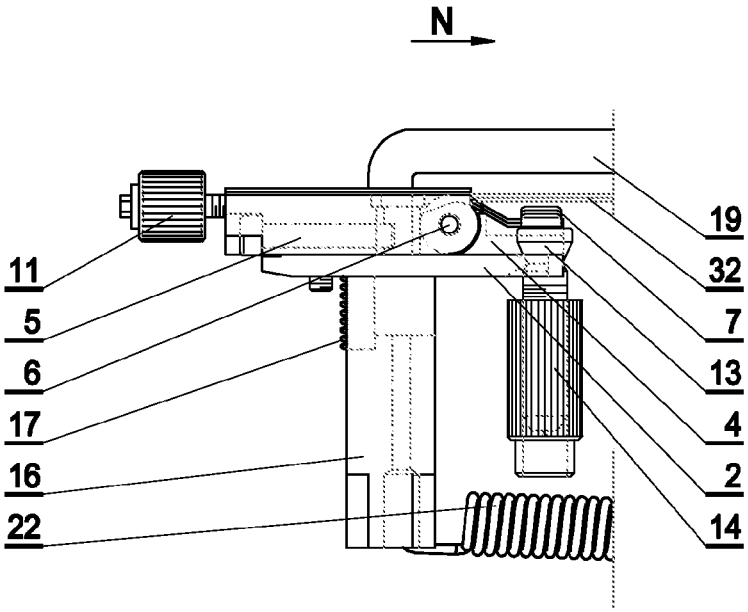
FIG. 5—a side view in the direction of the arrow N of FIG. 1.
Figure 17A:
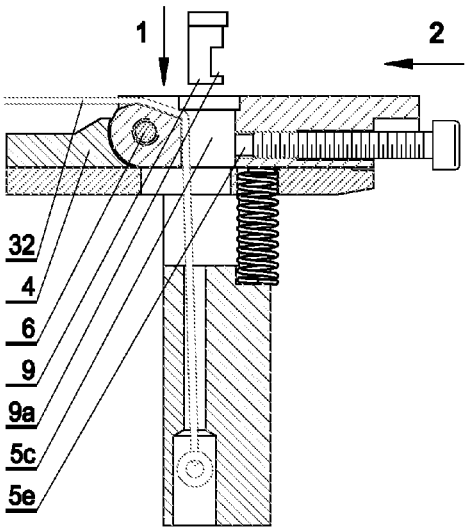
FIG. 17*a* and FIG. 17*b* illustrate the order of mounting the string lock insert.
Figure 17B:
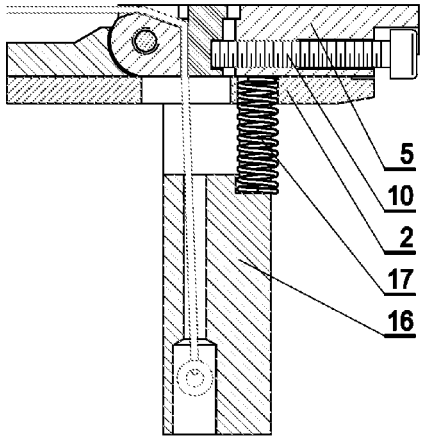

The string lock insert 9 illustrated in FIG. 3 and FIGS. 17*a* and 17*b*, which is mounted in the corresponding front slot 5*c* of the rear string saddle, is formed by a head and cylindrical body. The head of the string lock insert 9 prevents string lock insert from sinking in the front slot 5*c* of the rear 5 string saddle. On the other side, the head is vertically cut, forming a flat portion for free passing of the string. In the lower portion of the string lock insert 9 cylindrical body, a recess 9*a* is formed contacting the back portion of the string lock screw 10 (FIGS. 17*a* and 17*b*). The string lock insert 9 is mounted at the precise height by the shaped head so as the recess 9*a* is at the height of string lock screw 10. This construction of the string lock insert 9 allows self-adjustment of the insert during screwing up of the string lock screw 10 (illustrated in FIGS. 18*a*-18*c*) and fixing and locking of the string in the corresponding saddle assembly 3.

Figure 7:
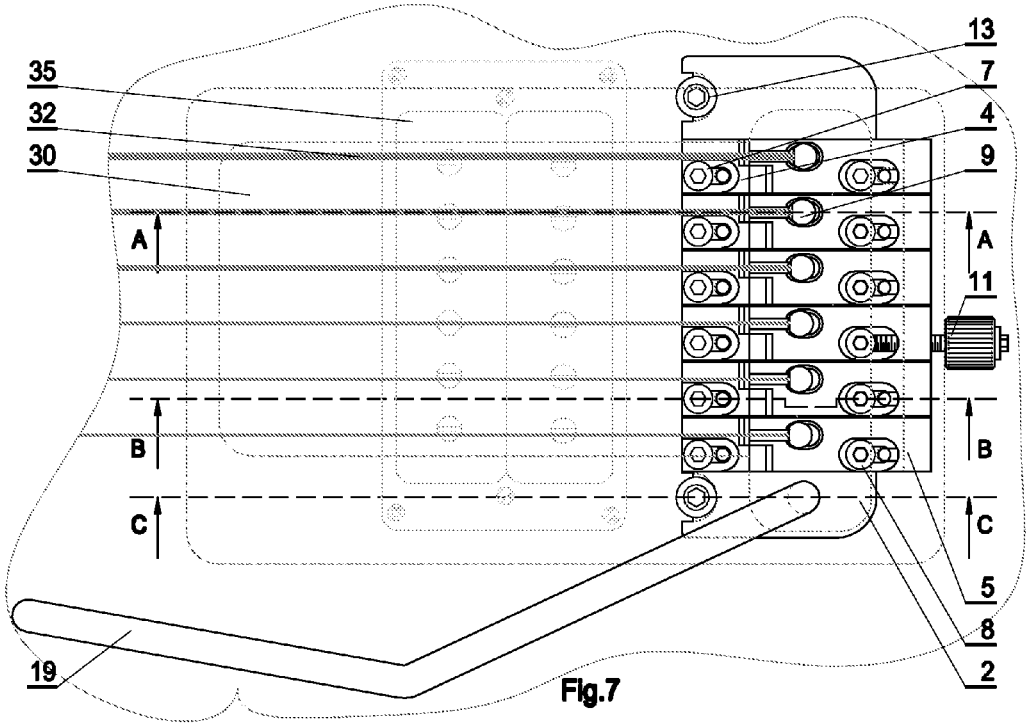
FIG. 7 is a view of the tremolo device according to the invention, mounted on the upper surface of the guitar body of FIG. 6.
Figure 8:
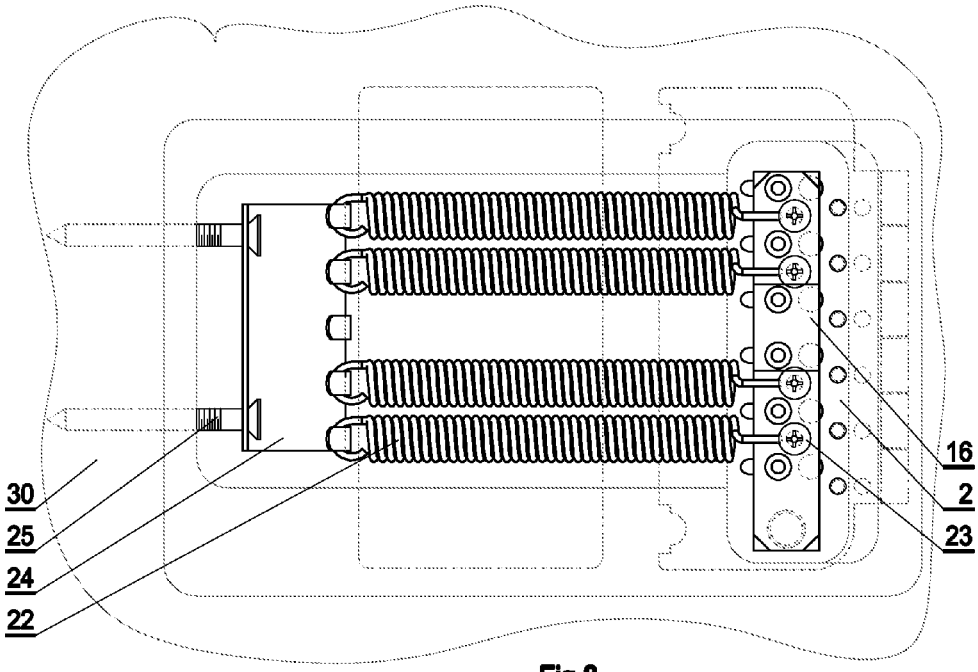
FIG. 8 is a view from the lower side of the tremolo device according to the invention with the guitar body of FIG. 6.
Figure 11:
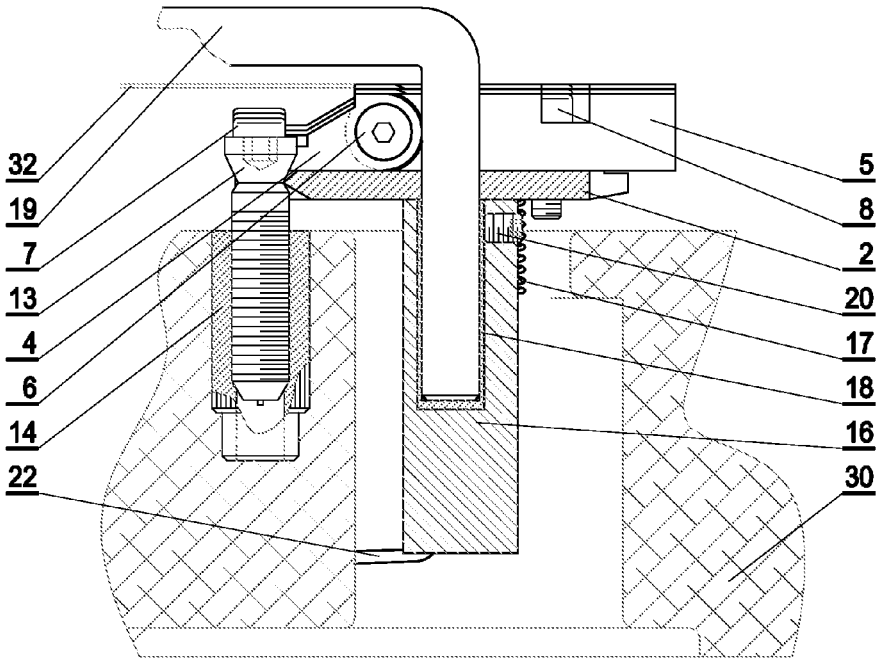
FIG. 11—is a part section taken through C-C of FIG. 7.

To the base plate 2 of the tremolo device 1 a pivot assembly 12 is provided, each assembly consisting of pivot stud 13 and pivot insert 14 (FIGS. 1, 7 and 11). In the front portion of the base plate 2 circular recesses are provided, beveled conically on the upper and lower side of base plate 2, so that at each circular recess a pointed edge is formed which fits into a formed double-cone recess under the head of each of the pivot studs 13 (FIG. 11). Thus, the two contact points determine a balancing axis for rotation of the tremolo device 1 with respect to the instrument body.

Figure 10:
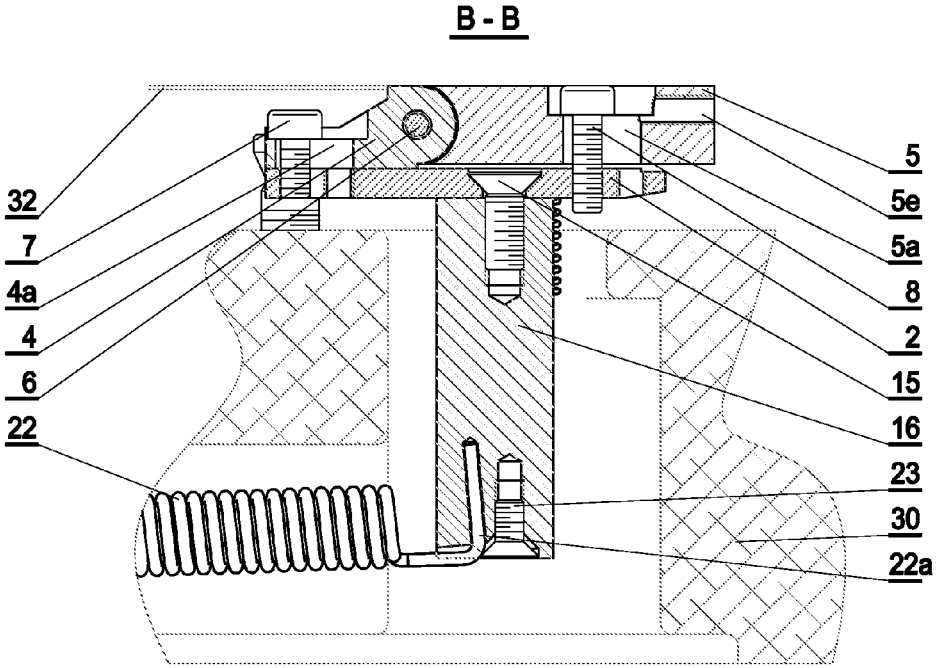
FIG. 10 is a part section taken through B-B of FIG. 7.

To the lower surface of the base plate 2 by means of tremolo block mounting screws 15, a sustain block 16 is mounted in which recesses 16*a* are formed corresponding to the number of the instrument strings (FIGS. 3 and 9). At the lower side of each recess 16*a* in the sustain block 16 are formed:

- a pass opening 16*b* for the corresponding string, each of the pass openings 16*b* being a two-step one (FIG. 9, FIGS. 14*a* and 14*b*) and its lower portion being of larger diameter, housing the ball at the end of the standard string;
- a spring housing 16*c* in which fine tuning spring 17 is mounted—a spring passing through an opening provided in the base plate 2 and which is limited by and contacts the lower surface of the corresponding rear string saddle 5 (FIG. 9 and FIGS. 15*a*-15*c*);

At one end of the base plate 2 and sustain block 16 a mechanism is provided for manipulation of the tremolo device 1 (FIGS. 1 and 3). In the sustain block 16 an opening with tremolo arm bush 18 is formed in which the tremolo arm 19 is mounted. The tremolo arm 19 is secured by tremolo arm lock screw 20 in the sustain block 16 and passes through an opening in the base plate 2 above the tremolo device 1 (FIG. 11);

On the sustain block 16 lower side a balancing mechanism 21 is mounted (FIG. 1 and FIG. 2), housed in a cavity provided at the lower side of the instrument body (FIG. 10). The balancing mechanism 21 includes two pairs of tremolo springs 22, which are fixed by spring hooks 22*a* formed at their ends and openings and spring fix screws 23 (FIG. 10) provided in the sustain block 16. The other ends of tremolo springs 22 are fixed to a spring claw 24 (FIG. 1 and FIG. 2), for static mounting to the instrument body (FIG. 8) by means of spring claw screws 25. In different embodiments of the tremolo device 1 the tremolo springs 22 of the balancing mechanism can be of different number—2, 3, 4 or 5.

The magnet adjustment screw 11, which is screwed up in upper threaded opening 5*d* on one of the rear string saddles 5 (FIG. 7 and FIG. 13*c*) includes a corpus 26, a hexagonal screw 27 and a magnet 28. The magnet adjustment screw 11 serves for precise intonation adjustment and for fine tuning of springs.

FIG. 6 is a schematic illustration of a stringed instrument, in particular an electric guitar 29 with tremolo device 1 according to the invention and double string locking. As shown in the figure, the guitar 29 includes a body 30 and neck 31 with strings 32. The neck 31 ends with headstock 33 on the back portion of which machine heads 34 are mounted for tuning of the instrument strings. The tremolo device 1 illustrated in FIG. 1 is mounted within the body 30 of the guitar 29 where also adapters 35 for the electronics are mounted. At the end of neck 31 a nut 36 is provided, tightly behind it a top lock unit 37 is mounted. The top lock unit 37 in combination with the nut 36 where the first contact point of the string 32 is and the tremolo device 1 according to the invention, where the second contact point is, provide the double locking of the instrument strings.

Figure 20:
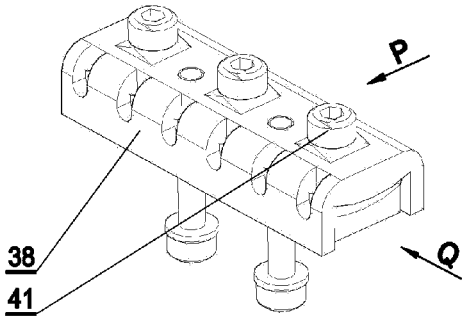
FIG. 20 is a plan axonometric view of the top lock unit mounted behind the guitar nut of FIG. 6.
Figure 21:
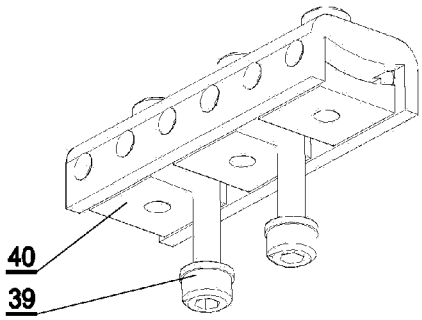
FIG. 21 is an axonometric view from the lower side of the top lock unit of FIG. 20.
Figure 22:
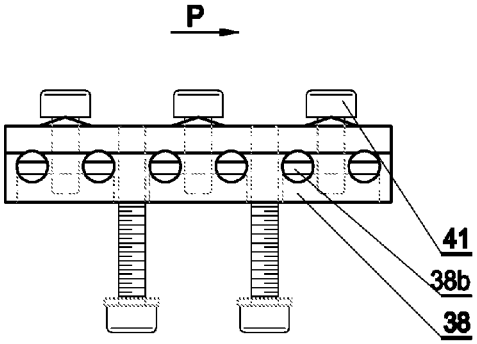
FIG. 22—a view in the direction of arrow P of FIG. 20.
Figure 23:
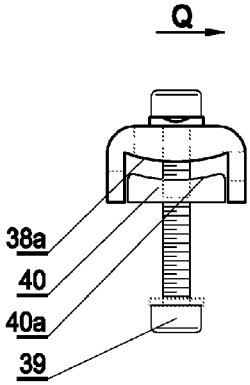
FIG. 23—a view in the direction of arrow Q of FIG. 20.
Figure 24:
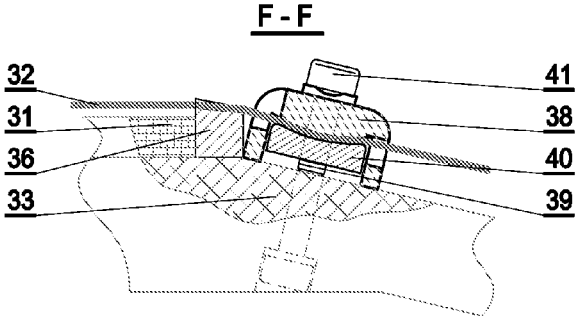
FIG. 24 is a section taken through F-F of FIG. 6 through the top lock unit and the guitar neck.

The top lock unit 37 illustrated in FIG. 20-FIG. 24, includes a top lock base 38 mounted to the neck 31 and the headstock 33 of the instrument 29 by means of top lock screws with washers 39. The top lock base 38 is U-shaped and convex upper oval wall 38*a* and with provided properly formed string openings 38*b* in the side walls of the U-shaped base as shown in FIGS. 20 and 22. On the inside part of the top lock base 38 clamping plates 40 are provided, their number can be different depending on the number of strings 32 of the instrument 29, in this case the clamping plates 40 are three for 6-stringed instrument. The plates 40 are formed with concave oval upper 40*a* surface, a mirror corresponding configuration to the inside convex upper wall 38*a* of the top lock base 38 and are pressed by clamping plate screws 41 with their upper surface to the inside upper side of the U-shaped top lock base 38 as illustrated in FIG. 24. Thus, in this particular embodiment each clamping plate 40 provides two adaptive recesses for every two strings 32 of the instrument which lie between the top lock base 38 and the corresponding clamping plate 40 as is illustrated in FIG. 23. At the same time in order to distribute the compression force on each pair of strings clamped by the corresponding clamping plate 40, on the upper side of the U-shaped top lock base 38, the surface under the heads of the clamping plate screws 41 is prism-formed as illustrated in FIGS. 20, 22 and 23.

Figure 25:
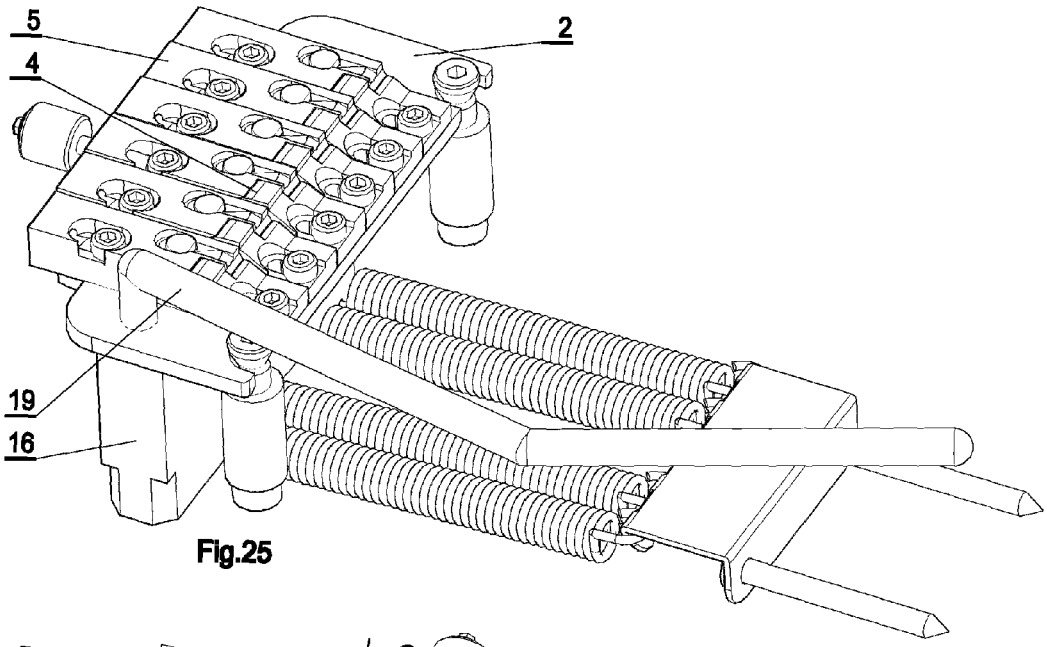
FIG. 25—gives a plan axonometric view of a second tremolo device embodiment according to the invention for right hand.

Another embodiment of tremolo device 1 according to the present invention is illustrated in FIG. 25, which is intended for right handed stringed instrument.

The tremolo device 1 (FIG. 25) is intended for right handed guitar and is easily adaptive, including all the elements of tremolo device 1 illustrated in FIGS. 1-19.

In the construction of tremolo device 1 for right hand, the base plate 2, a set of saddle assemblies 3, formed by front 4 and rear 5 string saddle, the sustain block 16 and the manipulation mechanism including tremolo arm 19 with tremolo arm bush 18 and tremolo arm lock screw 20 are formed and mirror mounted as illustrated in FIG. 25 with respect to the elements of tremolo device 1 for left hand illustrated if FIG. 1. So for example, the tremolo arm 19 with tremolo arm bush 18 and tremolo arm lock screw 20 are provided suitably on the base plate 2 right side. Furthermore, the front 4 and rear 5 string saddles of the saddle assemblies 3 have mirror-formed asymmetrically projecting arms with respect to the provided arms of the saddle assemblies 3 of the tremolo device for left hand, also the saddle assemblies 3 are mirror-disposed on the base plate 2 (FIG. 25) with respect to these of FIG. 1. In view of this, the embodiment of tremolo device of FIG. 25 and mounting it on instrument for right hand is within the knowledge and skills of the professionals in this field to realize it.

Figure 26:
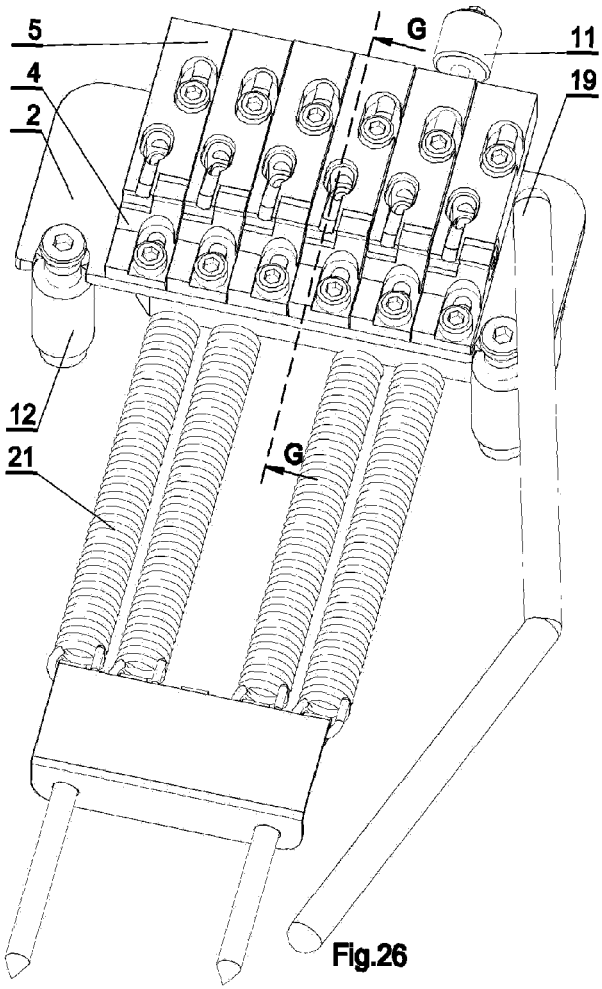
FIG. 26 is an axonometric view of another embodiment and application of the tremolo device according to the invention as standard tremolo.
Figure 27A:
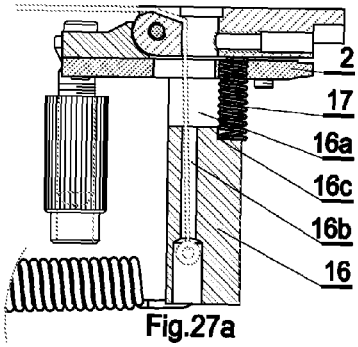
FIG. 27*a* and FIG. 27*b* are sections taken through G-G of FIG. 26, illustrating two ways of string mounting.
Figure 27B:
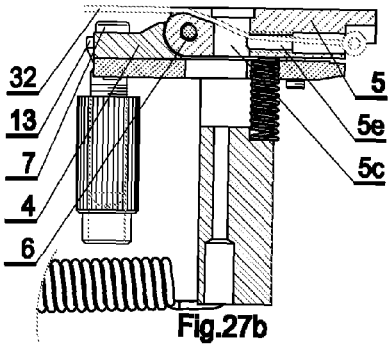

Another embodiment of the tremolo device according to the present invention is illustrated in FIG. 26 and FIG. 27*a* and FIG. 27*b*, which can be applied on stringed instruments as standard tremolo device (Non-Locking Tremolo).

According to this embodiment the standard tremolo device consists of flat base plate 2 on the upper surface of which are mounted independently of each other saddle assemblies 3, corresponding to the number of the instrument strings. As in the embodiment of FIG. 1, also in the device illustrated in FIG. 26 each saddle assembly 3 consists of front 4 and rear 5 string saddle, disposed in one plane on the base plate 2. The front 4 and rear 5 string saddles are movably connected by connecting element 6, disposed in the area of the asymmetric arms, mounted one next to the other, the connecting element 6 is disposed perpendicularly to the corresponding string allowing for the rotation of the rear string saddle 5. Forming of the front 4 and rear saddle 5 is identical to that in the embodiment illustrated in FIGS. 1-19. In the front 4 string saddle a slot 4*a* is formed in which a saddle mounting screw 7 is disposed, mounted in one of provided pair of threaded bores in the base plate 2 by means of which positioning, adjustment and fixing of the saddle assembly 3 is realized. In the rear 5 string saddle, coaxially to the slot 4*a*, a rear slot 5*a* is provided in which a fine tuning screw 8 is mounted. The sustain block 16 is mounted on the lower side of base plate 2, in it spring housings 16*c* for fine tuning springs 17 are provided, each spring passes through an opening in the base plate 2 and is limited by and contacts with the lower surface of the corresponding rear string saddle 5. In the front portion of the rear string saddle 5, a string receiving recess 5*b* is provided, extending to the formed front slot 5*c*, which axis is parallel to the rear slot 5*a*.

A feature of this embodiment of tremolo device according to the invention as standard tremolo is the lack of strings locking in the saddle assemblies; therefore no string lock insert 9 and string lock screw 10 are provided. In FIGS. 27*a* and 27*b* two embodiments of string positioning are illustrated.

According to FIG. 27*a* the string passes through string receiving recess 5*b* and the front slot 5*c* and is mounted in the formed pass two-step hole 16*b* for the corresponding string in the sustain block 16. Each pass hole 16*b* in the sustain block is a two-step hole (FIG. 27*a*), with greater diameter in its lower portion where the ball at the end of each string is housed. Thus, in embodiment of a standard tremolo device (Non-Locking Tremolo), the tremolo according to the invention in combination with the top lock unit in the neck end, the instrument comes out of tune rather more slowly.

According to FIG. 27*b* string 32 instead of being disposed in the corresponding pass two-step hole 16*b* of the sustain block 16, it is disposed in the lower threaded opening 5*e* in the rear string saddle 5, which lower threaded opening 5*e* is located from the back wall to the front slot 5*c* of the rear string saddle 5. Thus, the head (ball) of string 32 contacts with the narrowing portion of the lower threaded opening 5*e*, from the back side of rear string saddle 5 and passes through the front slot 5*c*. In this way of clamping string 32, the fine tuning function can be utilized, though a standard tremolo device is meant. Thus, in addition to the existing standard tremolo devices, the tremolo device according to the invention provides also opportunity for fine tuning.

Figure 28:
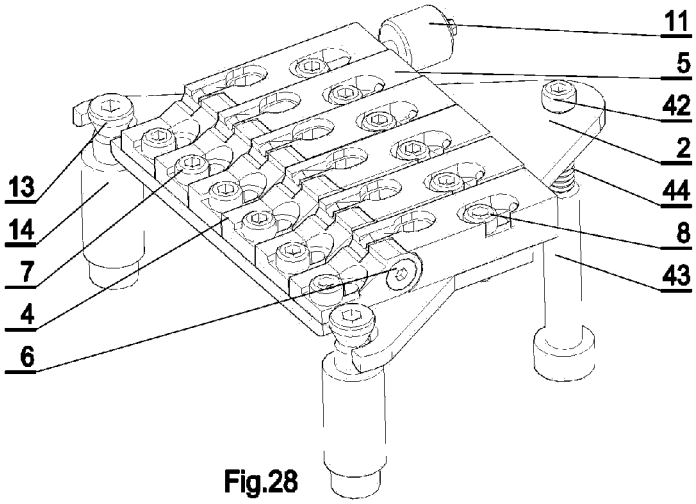
FIG. 28 is axonometric view of another embodiment and application of the device according to the invention as fixed bridge.
Figure 29:
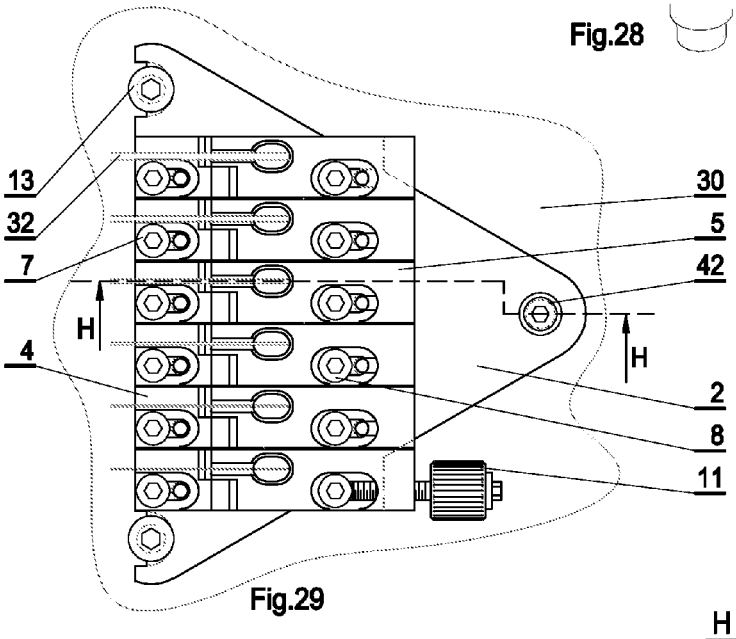
FIG. 29 is a top view of the device of FIG. 28 mounted to the guitar body of FIG. 6.
Figure 30:
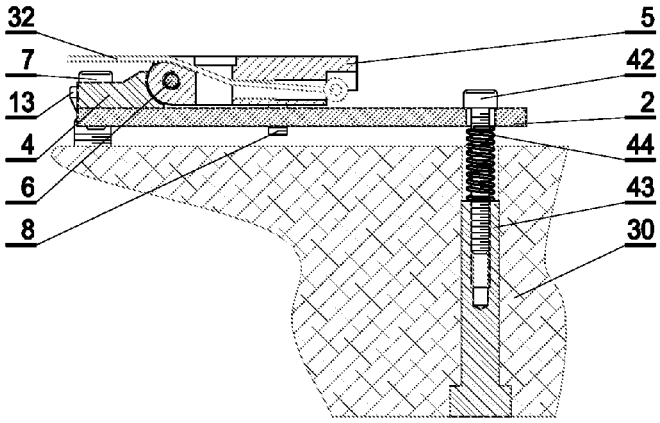
FIG. 30 is a section taken through H-H of FIG. 29.

FIGS. 28-30 illustrate an example of the present invention embodiment in stringed instruments as fixed bridge.

This structure of the device according to the invention features lack of sustain block 16 with the balancing mechanism 21 at the base plate 2.

In the particular embodiment, illustrated in FIGS. 28-30, the base plate 2 is triangular with the apex to the back side of the body 30 of the instrument, but another form is also possible. To the upper surface of the base plate 2, independently of each other saddle assemblies 3 are mounted, corresponding to the number of the instrument strings. The forming of the saddle assemblies 3 is identical to the forming illustrated in FIGS. 1-19. Each saddle assembly 3 consists of front 4 and rear 5 string saddle (FIG. 29) disposed one next to the other in a horizontal plane on the base plate 2 and are formed with asymmetric projecting arms. The arms of the front 4 and rear 5 string saddles are movably connected by connecting element 6, disposed perpendicularly to the corresponding string and allowing rotation of the rear 5 string saddle. According to a preferred embodiment the connecting element is a screw 6 passing freely through an opening in the front saddle 4 and is screwed up in a threaded bore in the rear string saddle 5. To each saddle assembly 3 elements are provided for positioning and fixing it to the base plate 2, as well as for fine tuning, wherein:

- in the front 4 string saddle a slot 4*a* is formed housing a saddle mounting screw 7 (FIG. 28), mounted in one of the provided pair of threaded bores in the base plate 2;
- in the back portion of the rear 5 string saddle a rear slot 5*a* is formed where a fine tuning screw 8 is provided, mounted to one of a pair of threaded bores in the base plate 2, and from the rear slot 5*a*, upper threaded opening 5*d* is disposed to the back side of the rear 5 string saddle;
- the saddle mounting screw 7 at the front 4 string saddle and the fine tuning string 8 at the rear 5 string saddle are disposed along one axial line (FIG. 29);
- in the front portion of the rear 5 string saddle a string receiving recess 5*b* is formed, reaching the formed front slot 5*c*, which axis is displaced and is parallel with respect to the back slot 5*a;*
- from the front slot 5*c* in the rear 5 string saddle, a lower threaded opening 5*e* is disposed to the back vertical wall of the rear 5 string saddle.

The tremolo device 1, illustrated in FIG. 28 is mounted as a fixed bridge to the stringed instrument 29, wherein the base plate 2 is fixed in its front end to its body by means of a pair of pivot assemblies 12, which serve also for strings regulation in height. Therefore, in the base plate 2 front end circular recesses are provided, conically beveled at the upper and lower side of the base plate 2, forming a pointed edge. The recesses contact with the pivot studs 13, mounted in pivot inserts 14, of the pivot assembly 12 which are fixed to the instrument body 30. Each string passes through the lower threaded opening 5*e* in the rear string saddle 5, where the head (the ball) of the string 32 is fixed in the narrowing portion of this two-step hole from the back side of the rear saddle 5 and extends in the front slot 5*c*. In this way of string 32 clamping, the fine tuning function can be utilized, though a stringed instrument with fixed bridge is meant.

At the back end of base plate 2 (at the apex of the triangular base plate 2) a pitch tuning screw 42 is provided, passing through the slot in the base plate 2. The pitch tuning screw 42 is mounted in pitch tuning bush 43, statically fixed in the instrument body 30 (FIG. 30) in a proper way. Between the upper surface of the pitch tuning bush 43 and the base plate 2 lower surface, an elastic element is provided—a pitch tuning spring 44, which compresses the base plate 2 in the head of pitch tuning screw 42. By screwing up or unscrewing pitch tuning screw 42 the pitch of all strings can be increased or decreased.

The above-proposed embodiment of the device according to the invention in FIGS. 28-30 possesses all advantages of the fixed bridge construction—the strings oscillations are transmitted more directly to the guitar body, better resonance is achieved, and the construction is simple and easily mounted. In addition with respect to most of the existing solutions, the device according to the invention provides for fine tuning and also increasing or decreasing the pitch of all strings (pitch tuning).

APPLICABILITY

The tremolo device 1, such as illustrated in FIG. 1 and FIG. 2, is completed by mounting to the base plate 2 lower surface the sustain block 16 to which fine tuning springs 17 and tremolo arm bush 18 for the tremolo arm 19 are mounted. FIG. 3 is an exploded view of the tremolo device 1 components according to the invention, the mounting points on the base plate 2 and the sustain block 16 are marked in thin lines.

To the base plate 2 upper surface, one after the other and independently of each other the saddle assemblies 3 are arranged and fixed, being mounted in advance by mounting the connecting element 6 in the front 4 and rear 5 string saddle. Thus, both front 4 and rear 5 string saddles lie with their lower surfaces on the upper surface of the base plate 2, which provides for low height of the tremolo device 1 profile and is of essential importance to guitarists.

Figure 13A:
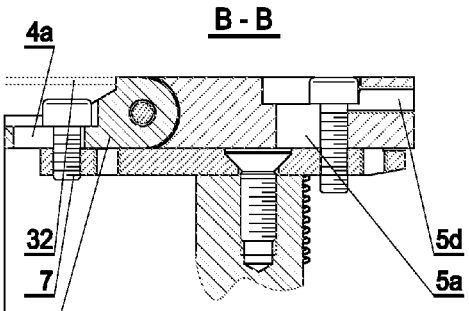
FIG. 13*a*-FIG. 13*d* illustrate the positioning of the saddle assembly from front end to back end position with "x" displacement.
Figure 14A:
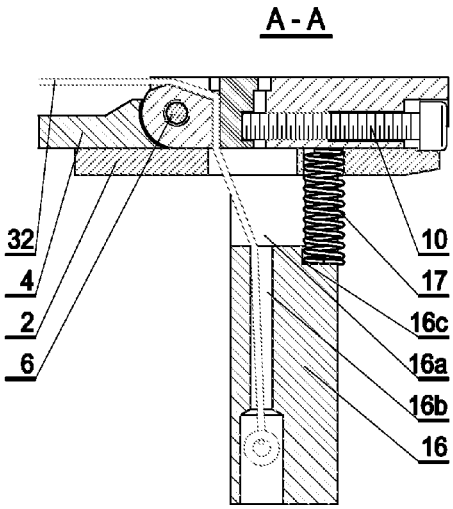
FIG. 14*a* and FIG. 14*b* illustrate the string position at front end and back positioning of the saddle assembly of FIGS. 13*a* and 13*d;*
Figure 13B:
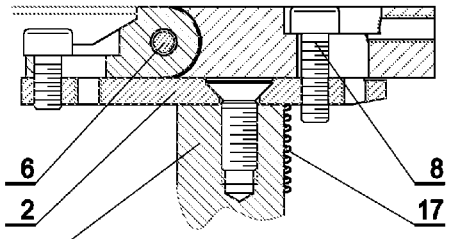
Figure 13C:
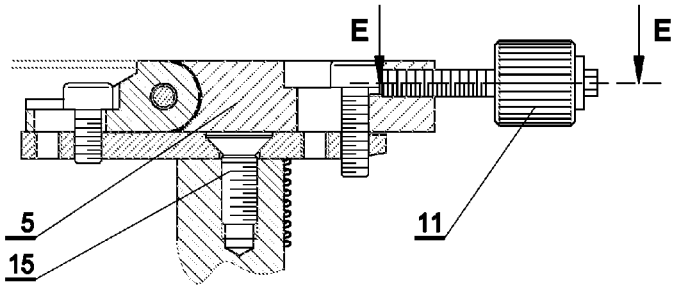
Figure 13D:
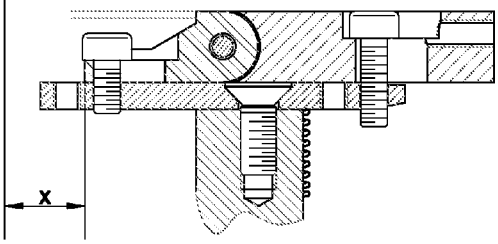
Figure 14B:
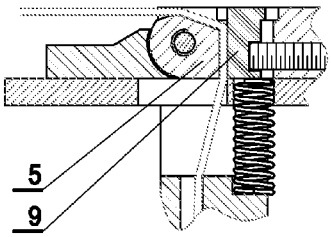
Figure 15A:
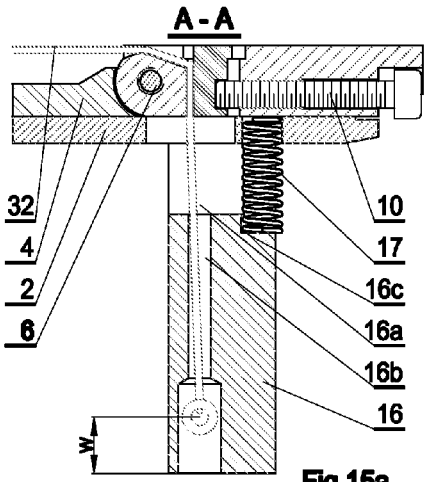
FIG. 15*a*-FIG. 15*c* illustrate the string location in locked position during fine tuning.
Figure 15B:
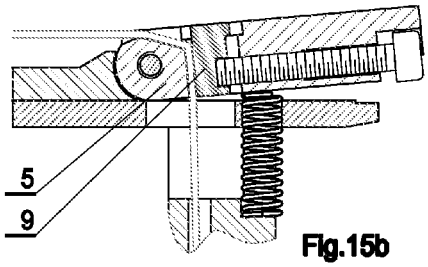
Figure 15C:
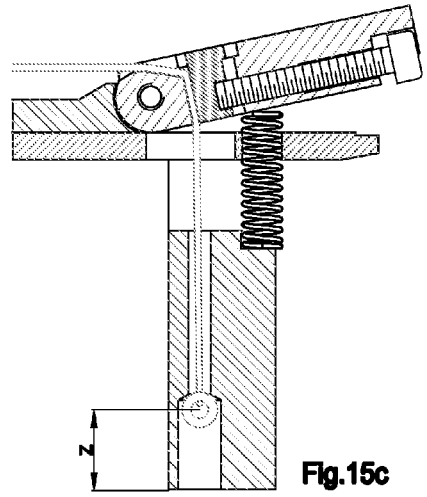

The saddle assemblies 3 are arranged depending on the location of the corresponding string 32, so as the saddle assemblies 3 which front 4 saddles are of the lowest height are for the first and sixth string, the highest ones—for the third and fourth string. To lock each saddle assembly 3 on the base plate 2, in the slot 4*a* of each front 4 string saddle the saddle mounting screw 7 is placed, which is mounted to the external bore of the pair of bores in the base plate 2, and in the slot 5*a* of the rear string saddle the fine tuning screw 8 is inserted, which is mounted to the inside bore of the pair of bores in the base plate 2, such as illustrated in FIG. 3 and FIG. 13*a*. Thus the coaxial slots 4*a* and 5*a* that are parallel but displaced with respect to the corresponding string 32 axis provide for quick, precise and easy tuning without the corresponding string obstructing this tuning.

Thus the completed base plate 2 with sustain block 16 of the tremolo device 1 are placed in the body 30 of the instrument 29 (FIG. 6) where in advance the pivot assemblies 12 are fixed with the pivot inserts 14 and pivot studs 13 to which the base plate 2 fits by means of the formed pointed edges in the circular recesses (FIG. 11). The pivot assembly 12 serves both as support point and also for strings 32 height regulation.

To the base plate 2 also the tremolo arm 19 is mounted, which is inserted tightly in the tremolo arm bush 18, which bush 18 is beforehand mounted in the sustain block 16. The tremolo arm 19 is fixed by proper tightening on the tremolo arm bush 18 by means of tremolo arm lock screw 20.

On the sustain block 16 lower side are mounted the tremolo springs 22 of the balancing mechanism 21 which are fixed (locked) by spring fix screws 23. The other end of tremolo springs 22 is fixed to the spring claw 24 which by means of spring claw screws 25 is fixed to the body 30 of the guitar 29.

After the tremolo device 1 is mounted to the instrument 29 (FIG. 6), the top lock unit 37 is mounted. To the neck 31 of the instrument 29, the top lock unit 37 is mounted tightly behind the nut 36 by inserting the top lock screws with washers 39 in the provided openings in the neck 31 to the top lock base 38. For easier and more precise mounting the clamping plates 40 are beforehand screwed up to the top lock base 38 by clamping plate screws 41 and then the top lock base 38 is screwed up to the headstock 33 by top lock screws with washers 39.

The closer the top lock unit 37 is to the nut 36, the less the linear shifts of the string 32 between the nut 36 and the top lock unit 37 are when using the tremolo arm 19. The most successful position of the top lock unit 37 is when the stretched and unlocked string 32 lies with enough pressure in the nut 36 housing and at the same time lies also on the oval surface of the top lock base 38. To meet this requirement, the top lock unit 37 according to the invention is provided with top lock base 38 which is formed with a convex upper oval surface 38*a* so that this convex surface provides compression on the string 32 as illustrated in FIG. 24. In this position of the top lock unit 37, the housing of the nut 36 through which the string passes is to remain underneath. When the stretched and tuned string 32 lies on the oval surface of the top lock unit 37, the change in tuning when locking is very little (almost insignificant) which results in very slight correction in fine tuning.

After mounting the tremolo unit 1 to the body 30 of the guitar 29 and mounting the top lock unit 37 to the neck 31 of the guitar 29, then placing and locking of strings 32, and adjusting and fine tuning of the instrument follows.

Mounting, Replacing and Locking of a String

Figure 16A:
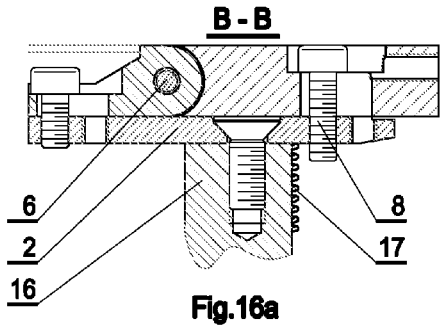
FIG. 16*a*-FIG. 16*c* illustrate the saddle assembly position during fine tuning by "y" rotating of the rear string saddle.
Figure 16B:
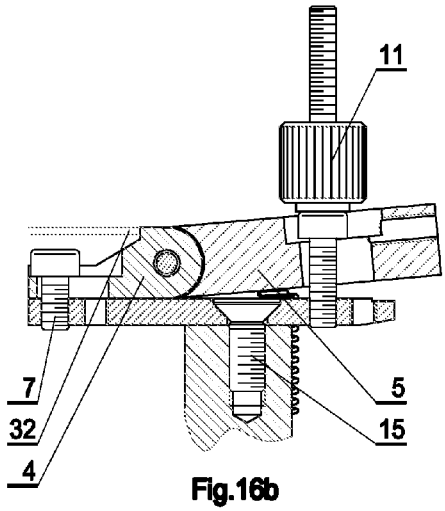
Figure 16C:
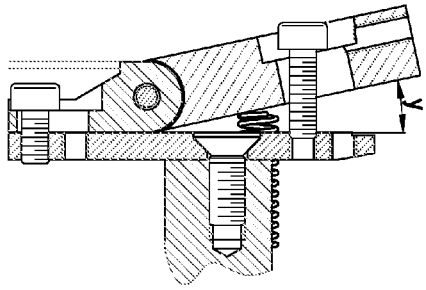
Figure 18A:
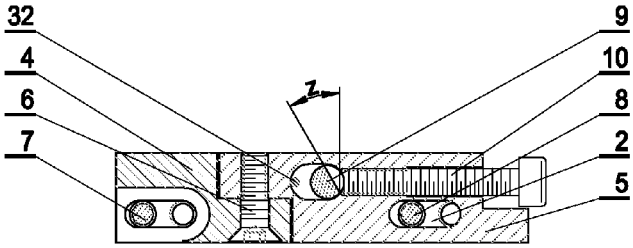
FIG. 18*a*-FIG. 18*c* illustrate the self-adjustment of the string lock insert of FIG. 17*b* and the string locking.
Figure 18B:
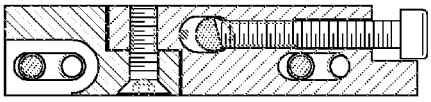
Figure 18C:
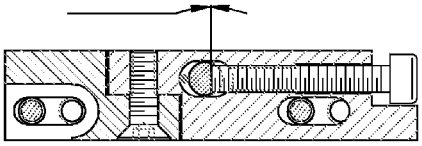
Figure 19:
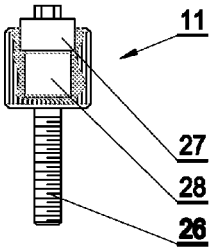
FIG. 19 is a part section taken through E-E through the magnet adjustment screw of FIG. 13*c;*

One of the most serious advantages of the tremolo device 1 according to the present invention is that strings 32 do not need cutting and thus the most spread standard strings can be used which are free at one end and at the other end have a ball. The mounting of new strings 32 is recommended to be performed string by string, where for tremolo device with string locking the mounting is performed in the following order:

1. The free end of each string 32 is inserted in the corresponding pass two-step hole 16*b* on the lower side of sustain block 16. The string is pulled through the opening at the base plate 2 and through the front slot 5*c* of the rear string saddle 5 until the string 32 ball reaches the narrowing portion of the pass two-step hole 16*b* as illustrated in FIGS. 15*a*-15*c* and FIGS. 17*a* and 17*b*. Besides, the fine tuning screw 8 is to be ensured in unscrewed position in the corresponding rear string saddle 5 to the highest position in the base plate 2, such as illustrated in FIG. 16*c*. This provides for wider range of tuning of the rear string saddle 5 by means of the fine tuning screw 8, wherein the string ball prevents the complete unscrewing of the fine tuning screw 8 at stretched string and breaking from the thread in the base plate 2.
2. In the front slot 5*c* in the rear string saddle 5 the string lock insert 9 is placed as illustrated in FIGS. 17*a* and 17*b*, the string lock insert 9 being oriented with the recess back side to the string 32, wherein in the lower threaded opening 5*e* the string lock screw 10 is screwed up from the back side of the rear string saddle 5 to its compressing string 32. This provides for self-adjustment of string lock insert 9 as illustrated in FIGS. 18*a*-18*c* and ensures secure locking of string 32 in the corresponding saddle assembly 3 of the tremolo device 1. Then the fine tuning screw 8 is wound in the corresponding bore of the base plate 2 by its mid free run;

3. The free end of string 32 is inserted in the corresponding openings of the top lock unit 37 so as to pass between the U-shaped top lock base 38 and the corresponding clamping plate 40 as shown in FIG. 24. Then string 32 is wound as known to the adjoining machine head 34 to the headstock 33 of the guitar 29 and is pulled and tuned so that the string contact point is on the nut 36. Clamping plate screws 41 of the clamping plates 40 are screwed up after all strings are tuned.

This procedure is repeated for each string.

It is recommended to perform strings replacement string by string, wherein:

string 32 is released from top lock unit 37 by unscrewing clamping plate screw 41 of the corresponding clamping plate 40 and unwinding from the corresponding machine head 34 on the headstock 33 of the guitar 29;

the string lock insert 9 is released by unscrewing the string lock screw 10;

the string 32 is pulled from the back of the guitar 29 through the pass two-step hole 16*b* in the sustain block 16.

The new string is mounted as described above.

Intonation Adjustment—Precise Saddle Positioning

The precise positioning of the saddle assemblies 3 to the tremolo device 1, also known as intonation adjustment, is performed individually for each string. This operation is obligatory for every replacement of a string. The main purpose of this extremely important adjustment is to precisely regulate the string 32 length so as that the distance from the nut 36, which is accepted as zero fret, to the 12-th fret, to be equal to that from the 12-th fret to the string receiving recess of the saddle assembly 3 in the tremolo device 1. In other words, this means that the tone played by the pressed at the 12-th fret string 32, has to be exactly one octave higher than the tone played at free string (0 fret). In performing this operation it is recommended to use the tuner device for tuning the strings. The positioning of the saddle assembly 3 for the corresponding string is performed consecutively, wherein:

1. The compression is released from the string 32 in the top lock unit 37 behind the nut 36, by means of unscrewing the clamping plate screw 41 of the corresponding clamping plate 40. The magnet adjustment screw 11 is screwed up in the upper threaded opening 5*d*, provided in the rear string saddle 5 until it stops in the head of the fine tuning screw 8, which is recommended to be in middle position.
2. The locking of the front string saddle 4 is released by unscrewing of the saddle mounting screw 7. In unlocked position of the front string saddle 4 the adjustment is performed by screwing up or unscrewing of the magnet adjustment screw 11 which with its back surface presses the fine tuning screw 8 head and the saddle assembly 3 moves backward or forward along the base plate 2. In the base plate 2 there are two possible threaded bores (FIG. 33, FIGS. 13*a*-13*d*) for screwing up of each saddle mounting screw 7 and two bores for each fine tuning screw 8. The availability of these four bores provides for enough displacement with "x" run of the saddle assembly 3 for adjustment without the necessity of extending slots 4*a* and 5*a* respectively in the front 4 and rear 5 string saddle, as illustrated in FIGS. 13*a*-13*d*. The location of the slot 4*a* for the saddle mounting screw 7 in the front string saddle 4 which is moved in parallel to the string, allows performing this adjustment without the need of pushing the string sideways in order to do this, which is a great convenience. After the front string saddle 4 is correctly positioned (by ongoing checking of the intonation), it is locked by screwing up the saddle mounting screw 7 to locking position.
3. Last checking of intonation of the corresponding string is performed at locked front string saddle 4 by checking also the tension in the tremolo springs 22 of the balancing mechanism 21. After this procedure is completed for all strings, the magnet adjustment screw 11 is unscrewed and inserted in any of the openings on the back side of saddle assembly 3.
4. The string 32 is locked also in the top lock unit 37 by means of screwing up the clamping plate screw 41.

The adjustment procedure for positioning of the corresponding saddle assembly 3 and respectively the strings intonation is repeated several times for each string to achieve the desired result.

Tremolo Device Height Adjustment (Strings Height)

The adjustment of the tremolo device 1 height, respectively the adjustment of strings 32 height is performed by means of the provided pivot assembly 12, each assembly consisting of pivot stud 13 screwed up in pivot insert 14 mounted in the body 30 of the guitar 29. Both pivot studs 13 bear the tremolo 1 base plate 2 by means of conical recesses formed in them in which the pointed edges (FIG. 11) are disposed of the circular recesses provided in the base plate 2. In counter clockwise rotation of the pivot studs the tremolo device 1 moves up and vice versa—in clockwise rotation the tremolo device 1 moves down. No individual string adjustment is needed as the saddle assemblies 3 height is different. The saddle assemblies for the first and sixth string are the lowest, then the saddle assemblies for the second and fifth string are higher, and the saddle assemblies for the third and fourth string are the highest. This difference in height is due to the fact that the neck 31 surface under the strings 32 is rounded for greater convenience when playing the instrument. Both pivot studs serve also as pivot axis around which the base plate 2 of the tremolo device 1 rotates, balancing on one side the tension force in strings and of the tremolo springs 22 of the balancing mechanism 21 on the other side.

Fine Tuning of a String

According to the invention the guitar 29 with double locking tremolo device 1 allows performing the strings fine tuning also with two-sidedly locked strings in the tremolo device 1 by means of the string lock insert 9 and string lock screw 10 as well as at the top lock unit 37.

The magnet adjustment screw 11, formed as a hexagonal wrench is stuck to the head of the fine tuning screw 8. The power of the magnet inbuilt in the magnet adjustment screw 11 ensures its secure sticking to the fine tuning screw 8. This ensures the fixing of screw 11 even when turning and inclining the guitar 29 which is especially necessary when performing the fine tuning. The usual position of the guitar in this operation is vertical. By screwing up or unscrewing the fine tuning screws 8 of each string 32, their tuning is performed. It is recommended to position the fine tuning screws 8 at the mid position of their vertical run prior to tuning and locking the strings. After this tuning is completed, the magnet adjustment screw 11 is screwed up again in unoccupied opening in the back of some of the rear string saddles 5. Even so, screw 11 does not obstruct the tremolo 1 run at its rotation around the support points.

Tremolo Springs Adjustment

The position of the tremolo device 1 depends on the tension force in the tremolo springs 22 and on the tension force in the strings 32. The positioning of the tremolo device 1 is performed with unlocked strings 32 on the side of the top lock unit 37. This is required because of the fact that during adjustment it is necessary to tune the strings 32 by the machine heads of the instrument.

The system is balanced when the base plate 2 of the tremolo device 1 is parallel to the surface of the body 30 of the guitar 29, in this case the functionality of the tremolo device and of the stringed instrument is ensured. In case that both surfaces of the base plate 2 and the upper surface of the body 30 of the guitar 29 are not parallel, it is necessary to remove the cover of the back side of the guitar and by screwing up or unscrewing of spring claw screws 25 to the spring claw 24 to increase or decrease the tension force in the tremolo strings 22.

When replacing strings, prior to starting tuning of strings and balancing, it is necessary to mount the desired number of springs from the guitar back, they may be 2 (two), 3 (three), 4 (four) or 5 (five) in number depending on their characteristics. In the embodiment shown in FIGS. 1-19, the number of tremolo springs 22 is 4 (four). The more tremolo springs 22 are mounted, the greater effort has to be applied to the tremolo arm 19 of the tremolo unit. The choice of the springs number is individual, most often the number of tremolo springs 22 in guitars is 3 (three).

Tremolo Arm Adjustment

The tremolo arm 19 to operate the tremolo is mounted in the opening on the base plate 2 of the tremolo device 1, where is fits best in plastic tremolo arm bush 18, fixed in the sustain block 16. By screwing up or unscrewing of the tremolo arm lock screw 20 for tightening, the effort of rotating the tremolo arm 19 in the desired position is increased or decreased, as well as the opportunity of removing it from the tremolo device.

The invention claimed is:

1. Tremolo device for stringed instrument including a base plate, movably mounted to the instrument body via pivot assembly, on the base plate upper surface a set of saddle assemblies are mounted independently of each other, their number corresponding to the number of strings of the instrument, each saddle assembly containing a front and rear string saddle, connected by a connecting element disposed perpendicularly to the corresponding string and allowing for rotation of the rear string saddle, wherein to each saddle assembly means are provided for fixing them to the base plate, for fine tuning and intonation, and on the base plate lower surface a sustain block is mounted, at the lower end of which a balancing mechanism is settled with elastic elements, fixed in their other end to the instrument body, to the tremolo device a manipulation mechanism with tremolo arm for manipulation is also provided for, wherein:

the front (4) and (5) rear string saddle of each saddle assembly (3) are disposed on the base plate (2) upper surface and are formed with asymmetrically projecting arms which are connected by the connecting element (6), as in the front portion of the front (4) string saddle a slot (4*a*) is formed through which a saddle mounting screw (7) is passed and mounted to the base plate (2), and in the back portion of the rear string saddle (5), coaxially to the slot (4*a*), a rear slot (5*a*) is formed through which a fine tuning screw (8) is mounted and fixed to the base plate (2), wherein from the slot (5*a*) to the back wall of the rear string saddle (5) upper threaded opening (5*d*) is extended for intonation adjustment with horizontal displacement "x" by means of a magnet adjustment screw (11);

in the front portion of the rear string saddle (5), in parallel to the axis of slots (4*a*) and (5*a*), a string receiver recess (5*b*) is formed, extending to provided front slot (5*c*) from which a lower threaded opening (5*e*) extends reaching the back wall of the rear (5) string saddle;

in the sustain block (16) recesses (16*a*) are formed, whose number corresponds to the number of instrument strings, as in the recesses (16*a*) pass two-step holes (16*b*) and spring housings (16*c*) are formed, where in the spring housings (16*c*) spring elements (17) are mounted passing through openings provided in the base plate (2) and contacting with the lower surface of the rear string saddles (5), for rotation of the rear (5) string saddle at "y" angle with respect to the base plate (2) surface.

2. Tremolo device for stringed instrument according to claim 1, wherein to the rear (5) string saddle of each saddle assembly (3), corresponding to the instrument strings number, a string lock insert (9) is secured which is mounted in the front slot (5*c*) of the rear (5) string saddle wherein the string lock insert (9) is fixed by a string lock screw (10) provided in lower threaded opening (5*e*) to the back wall of the rear (5) string saddle for locking the corresponding string of the instrument.

3. Tremolo device for stringed instrument according to claim 2, wherein the string lock insert (9) is formed with a head and a cylindrical body, the head being cut off to form a flat portion, and opposite it, in the cylindrical body lower portion a recess (9*a*) is formed, intended to receive the back portion of the string lock screw (10).

4. Tremolo device for stringed instrument according to claim 1, wherein the connecting element (6) for the front (4) and rear (5) string saddle is constructed as a screw or a support shaft.

5. Tremolo device for stringed instrument according to claim 1, wherein the magnet adjustment screw (11) for intonation adjustment of the saddle assemblies (3) and for the fine tuning screw (8) adjustment, includes a corpus, a hexagonal screw and a magnet.

6. Tremolo device for stringed instrument according to claim 1, wherein the balancing mechanism (21) includes tremolo springs (22) which are fixed to the lower side of the sustain block (16) by means of suspending elements formed as spring hooks (22*a*) and spring fix screws (23), and in the other end the tremolo springs (22) are hung to spring claw (24) mounted to the instrument body by spring claw screws (25).

7. Tremolo device for stringed instrument according to claim 1, wherein the tremolo arm (19) for manipulation is mounted in the tremolo arm bush (18) provided in the sustain block (16) which tremolo arm (19) passes through an opening in the base plate (2) and is fixed by tremolo arm lock screw (20) in the sustain block (16).

8. Stringed musical instrument including a body from which a neck extends, to which a headstock is provided with machine heads and a set of strings disposed on the neck, wherein in the neck end a nut and top lock unit are provided, and to the upper surface of the instrument body a tremolo device and adapters are mounted, wherein:

the tremolo device (1), according to claim 1, is movably mounted to the body (30) of the instrument (29) by means of pivot studs (13) and pivot inserts (14) which are fixed in the body (30), as the set of strings (32), from the neck through the nut and the top lock unit, are disposed in the tremolo device (1);

the top lock unit (37) is mounted tightly behind the nut (36) on the headstock (33) of the instrument (29) by means of top lock screws with washers (39) and consists of U-shaped top lock base (38) with convex upper oval surface (38*a*) and provided suitably shaped string openings (38*b*) for strings (32) in the side walls, wherein in the U-shaped area of the top lock base (38) clamping plates (40) are provided, their number depending on the number of the instrument (29) strings (32), the clamping plates (40) being formed with concave upper oval surface (40*a*), a mirror correspondence to the convex upper oval surface (38*a*) of the top lock base (38) and are compressed by clamping plate screws (41) with their upper surface to the inside convex upper oval surface (38*a*) of the U-shaped top lock base (38), each clamping plate (40) forming two adaptive recesses in which every two strings (32) of the instrument (29) are fixed.

9. Stringed instrument according to claim 8, wherein the tremolo device (1) string lock inserts (9) are provided, corresponding to the number of strings (32) of the instrument, as each string lock insert (9) for the corresponding string (32) is mounted in the front slot (5*c*) of the corresponding rear (5) string saddle of every saddle assembly (3) and is fixed by a string lock screw (10) provided in lower threaded opening (5*e*) to the back wall of the rear (5) string saddle for locking the corresponding string (32) of the instrument (29), wherein the corresponding string (32) disposed in the provided pass two-step hole (16*b*) in the sustain block (16) of the tremolo device (1) with the ball on the lower side of the pass two-step hole (16*b*), extends through the front slot (5*c*) in the rear (5) string saddle where it is fixed with the string lock insert (9) and is locked by the string lock screw (10), after that the respective string (32) extends over the string receiver recess (5*b*) in the rear (5) string saddle, over the neck (31) and nut (36) and is fixed in the top lock unit (37) and in the corresponding machine head (34) to the instrument (29) headstock (33).

10. Stringed musical instrument according to claim 8, wherein in the tremolo device (1), the respective string (32) is provided with the ball in the lower side of its corresponding pass two-step hole (16*b*) in the sustain block (16) of the tremolo device (1) and extends through the recess (16*a*) through a opening in the base plate (2) in the front slot (5*c*) in the rear (5) string saddle, then the respective string (32) is disposed over the string receiver recess (5*b*) for string (32) in the rear (5) string saddle, over the neck (31), the nut (36) and is fixed in the top lock unit (37) and the corresponding machine head (34) to the headstock (33) of the instrument (29).

11. Stringed musical instrument according to claim 8, wherein in the tremolo device (1) the respective string (32) is mounted in the rear (5) string saddle of the corresponding saddle assembly (3), so as the string (32) ball contacts with the narrowing portion formed in the lower threaded opening (5*e*), after which it passes through the front slot (5*c*) in the rear (5) string saddle and extends over the provided string receiver recess (5*b*) for string (32), over the neck (31), the nut (33) and is fixed in the top lock unit (37) and in the corresponding machine head (34) to the headstock (33) of the instrument (29).

12. Tremolo device for stringed instrument according to claim 2, wherein the connecting element (6) for the front (4) and rear (5) string saddle is constructed as a screw or a support shaft.

13. Tremolo device for stringed instrument according to claim 2, wherein the magnet adjustment screw (11) for intonation adjustment of the saddle assemblies (3) and for the fine tuning screw (8) adjustment, includes a corpus, a hexagonal screw and a magnet.

14. Tremolo device for stringed instrument according to claim 2, wherein the balancing mechanism (21) includes tremolo springs (22) which are fixed to the lower side of the sustain block (16) by means of suspending elements formed as spring hooks (22*a*) and spring fix screws (23), and in the other end the tremolo springs (22) are hung to spring claw (24) mounted to the instrument body by spring claw screws (25).

* * * * *